US010526837B2

(12) United States Patent
Jao et al.

(10) Patent No.: US 10,526,837 B2
(45) Date of Patent: Jan. 7, 2020

(54) CONTROL SYSTEM FOR WINDOW SHUTTER

(71) Applicant: NIEN MADE ENTERPRISE CO., LTD., Taichung (TW)

(72) Inventors: Jui-Pin Jao, Hsinchu County (TW); Wei-Ting Hsu, Hsinchu County (TW); Shu-Wei Hu, Hsinchu (TW); Lin Chen, Guangdong (CN); Chao-Hung Nien, Taichung (TW)

(73) Assignee: NIEN MADE ENTERPRISE CO., LTD., Taichung (TW)

( * ) Notice: Subject to any disclaimer, the term of this patent is extended or adjusted under 35 U.S.C. 154(b) by 204 days.

(21) Appl. No.: 15/700,809

(22) Filed: Sep. 11, 2017

(65) Prior Publication Data

US 2019/0078377 A1 Mar. 14, 2019

(51) Int. Cl.

| | |
|---|---|
| ***E06B 7/096*** | (2006.01) |
| ***E06B 7/086*** | (2006.01) |
| ***E05F 15/619*** | (2015.01) |

(52) U.S. Cl.

CPC ..... *E06B 7/096* (2013.01); *E05F 15/619* (2015.01); *E06B 7/086* (2013.01); *E05Y 2900/146* (2013.01)

(58) Field of Classification Search

CPC . E06B 7/096; E06B 7/094; E06B 9/28; B60K 11/085; E05F 15/614; E05F 15/619; E05Y 2900/146

See application file for complete search history.

(56) References Cited

U.S. PATENT DOCUMENTS

| | | | | |
|---|---|---|---|---|
| 2,675,228 | A * | 4/1954 | Baird | E06B 7/086 49/21 |
| 6,014,839 | A * | 1/2000 | Ruggles | E06B 7/086 327/307 |
| 6,568,131 | B1 * | 5/2003 | Milano, Jr. | E06B 7/096 49/25 |
| 9,732,553 | B2 * | 8/2017 | Rotchell | E06B 7/086 |

(Continued)

FOREIGN PATENT DOCUMENTS

| | | |
|---|---|---|
| CA | 2897028 A1 | 1/2016 |
| CN | 205955595 U | 2/2017 |

(Continued)

*Primary Examiner* — Justin B Rephann

(74) *Attorney, Agent, or Firm* — Muncy, Geissler, Olds & Lowe, P.C.

(57) ABSTRACT

A control system for a shutter is disclosed. The shutter includes a force-bearing mechanism and a plurality of slats. The control system includes a power source, a driving device connected to the power source to output a first driving force, which drives the force-bearing mechanism to rotate the slats, and a clutch mechanism, which includes an input member and an output member which are drivable to be connected together for synchronous operation, or to be mutually disconnected for independent operation. When the driving device outputs the first driving force, the input member is engaged with the output member, and the first driving force can be transmitted to the force-bearing mechanism through the clutch mechanism to rotate the slats. When the driving device stops, the input member is disengaged from the output member, and the slats and the force-bearing mechanism are rotatable relative to the driving device.

26 Claims, 30 Drawing Sheets

(56) References Cited

U.S. PATENT DOCUMENTS

| | | | | |
|---|---|---|---|---|
| 2005/0183833 | A1* | 8/2005 | Vasquez | E06B 7/096 160/133 |
| 2009/0283227 | A1 | 11/2009 | Mohat et al. | |
| 2016/0032642 | A1* | 2/2016 | Rotchell | E06B 7/086 49/82.1 |
| 2016/0376834 | A1 | 12/2016 | Meyerink et al. | |
| 2018/0179808 | A1* | 6/2018 | Fraser | E06B 9/04 |
| 2019/0032397 | A1* | 1/2019 | Sosa | E06B 7/10 |

FOREIGN PATENT DOCUMENTS

| | | | |
|---|---|---|---|
| CN | 205955595 | U | 2/2017 |
| GB | 2329575 | A | 3/1999 |
| GB | 2334069 | A | 8/1999 |
| GB | 2553469 | A | 3/2018 |
| WO | 2013138578 | A1 | 9/2013 |
| WO | 2017121875 | A1 | 7/2017 |

* cited by examiner

CONTROL SYSTEM FOR WINDOW SHUTTER

BACKGROUND OF THE INVENTION

1. Technical Field

The present disclosure relates generally to a window shutter, and more particularly to a control system adapted to control the amount of light that passes through the window shutter by automatically switching between an electric mode and a manual mode to adjust a tilt angle of slats.

2. Description of Related Art

Generally, a window is installed at an opening of a building in an operable manner to connect or separate an inside and outside of the building. It is also common to further install a window shutter on an outer side or an inner side of the window in parallel to a glass surface thereof, in order to adjust the amount of light entering the building. Such a shutter includes a top beam, a bottom beam in parallel to the top beam, and two posts fixed between the top beam and the bottom beam, wherein the top beam, the bottom beam, and the two posts form a frame. One of the posts may be pivotally positioned on a lateral side of the window, whereby the shutter could be pivoted about the lateral side of the window toward or away from the glass surface of the window. In this way, the shutter can cover or uncover the opening. In addition, the shutter includes a plurality of slats provided in parallel between the top beam and the bottom beam, wherein two ends of each of the slats are respectively connected to the two posts in a manner that the slats can be flipped upward or downward, and the slats are connected through a transmission structure to be turned synchronously to the same degree. Therefore, when the shutter covers the opening of the building, the amount of light passing through the opening can be controlled by synchronously adjust a tilt angle of the slats through the transmission structure.

The current practices for adjusting the tilt angle of the slats can be classified into manual and electric methods. Both kinds of methods use the transmission structure to synchronously turn the slats, so as to adjust the tilt angle of all of the slats of the shutter. The only difference between these two kinds of methods is whether the operation is performed by hand or by electric means (e.g., motors). The Chinese Patent No. CN205955595U discloses a shutter compatible to both manual and electric methods. However, the slats can be only driven in either manual or electric methods at one time, and therefore, a clutch device is needed for such a shutter, wherein the clutch device has a switching member which is adapted to be operated to switch between a manual driving mode and an electric driving mode to adjust the slats. In the electric driving mode, the slats are driven to synchronously rotate by a motor; in the manual driving mode, the clutch device dismisses the linking between the slats and the motor, so that the transmission between the slats and the motor is halted. Though such design has the advantage that the slats can be driven in either driving mode, a careless user may try to manually flip the slats when the shutter is in the electric driving mode. At the moment, the slats are still linked to the motor. When the motor is idle, it strictly prohibits the slats from turning. Once the slats are forcibly flipped by hand in such state, related components might get damaged, for the force provided by the user would be mainly gathered on two ends of the flipped slats. This is a significant disadvantage in use.

BRIEF SUMMARY OF THE INVENTION

In view of the above, the primary objective of the present disclosure is to provide a control system for a window shutter, wherein the control system includes a clutch mechanism, which could automatically disconnect the slats from the motor when the motor is not actuated, whereby to automatically switch into a manual driving mode to drive the slats, and therefore, the slats could be freely flipped relative to the motor. When the motor is actuated, the motor would be automatically engaged with the slats through the clutch mechanism to drive the slats. Accordingly, the automatic switching of the clutch mechanism could prevent the slats of the window shutter and the connected points of the slats from being damaged.

The present disclosure provides a control system for a shutter, which includes a force-bearing mechanism and a plurality of slats. The control system includes a power source, a driving device and a clutch mechanism. The driving device is connected to the power source, and is adapted to be driven by the power source to output a first driving force, wherein the first driving force is used to drive the force-bearing mechanism to rotate the slats. The clutch mechanism could be driven to allow the driving device to drive the force-bearing mechanism, and includes an input member and an output member, wherein the input member and the output member are able to be driven to be connected to each other to be operated synchronously, and the input member and the output member are also able to be driven to be disconnected from each other to be operated independently. When the driving device outputs the first driving force, and the input member of the clutch mechanism is engaged with the output member, the first driving force would be transmitted to the force-bearing mechanism through the clutch mechanism, whereby to drive the slats to rotate. When the driving device stops outputting the first driving force, the input member of the clutch mechanism would be disengaged from the output member, and the slats and the force-bearing mechanism are able to rotate independently relative to the driving device.

With the design of the aforementioned control system, a function of one aspect of the present disclosure is that, the driving device could generate the first driving force to drive the force-bearing mechanism through the automatic engagement of the clutch mechanism while the driving device of the control system is operated, whereby to rotate the slats of the shutter. When the control system stops operating, the driving relation between the driving member and the force-bearing mechanism would be dismissed through the automatic disconnection of the clutch mechanism, so that the slats could be rotated independently relative to the driving device. Therefore, the driving mode of the slats could be automatically switched between electric or manual.

BRIEF DESCRIPTION OF THE SEVERAL VIEWS OF THE DRAWINGS

The present disclosure will be best understood by referring to the following detailed description of some illustrative embodiments in conjunction with the accompanying drawings, in which.

DETAILED DESCRIPTION OF THE INVENTION

For ease of understanding the present disclosure, several embodiments and accompanying drawings are illustrated as follows.

Figure 2:
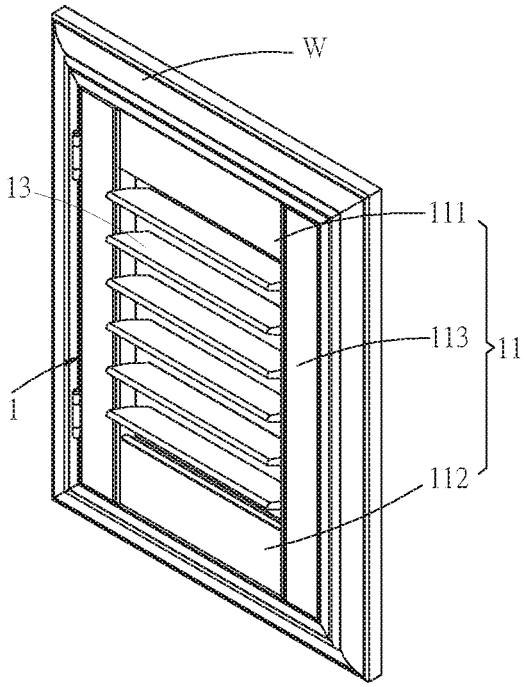
FIG. 2 is a perspective view of the shutter applied with the control system of the present disclosure, in which the slats of the shutter are opened.
Figure 3:
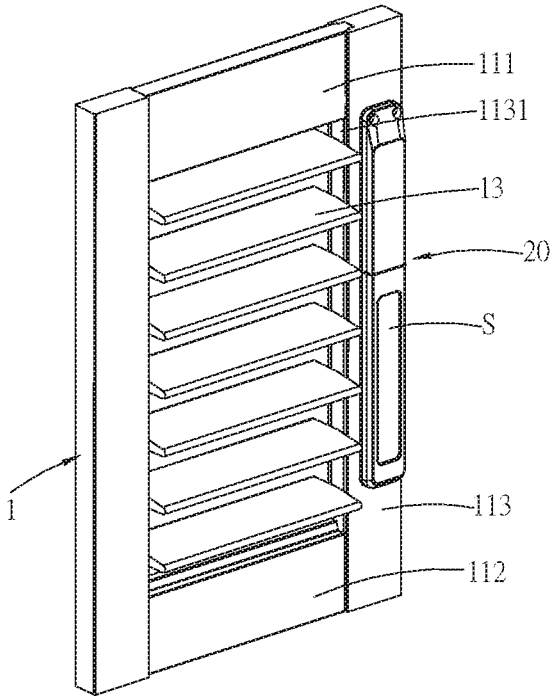
FIG. 3 is a perspective view, showing the location where the control system of a first embodiment of the present disclosure is installed in the shutter shown in FIG. 1 and FIG. 2.
Figure 4:
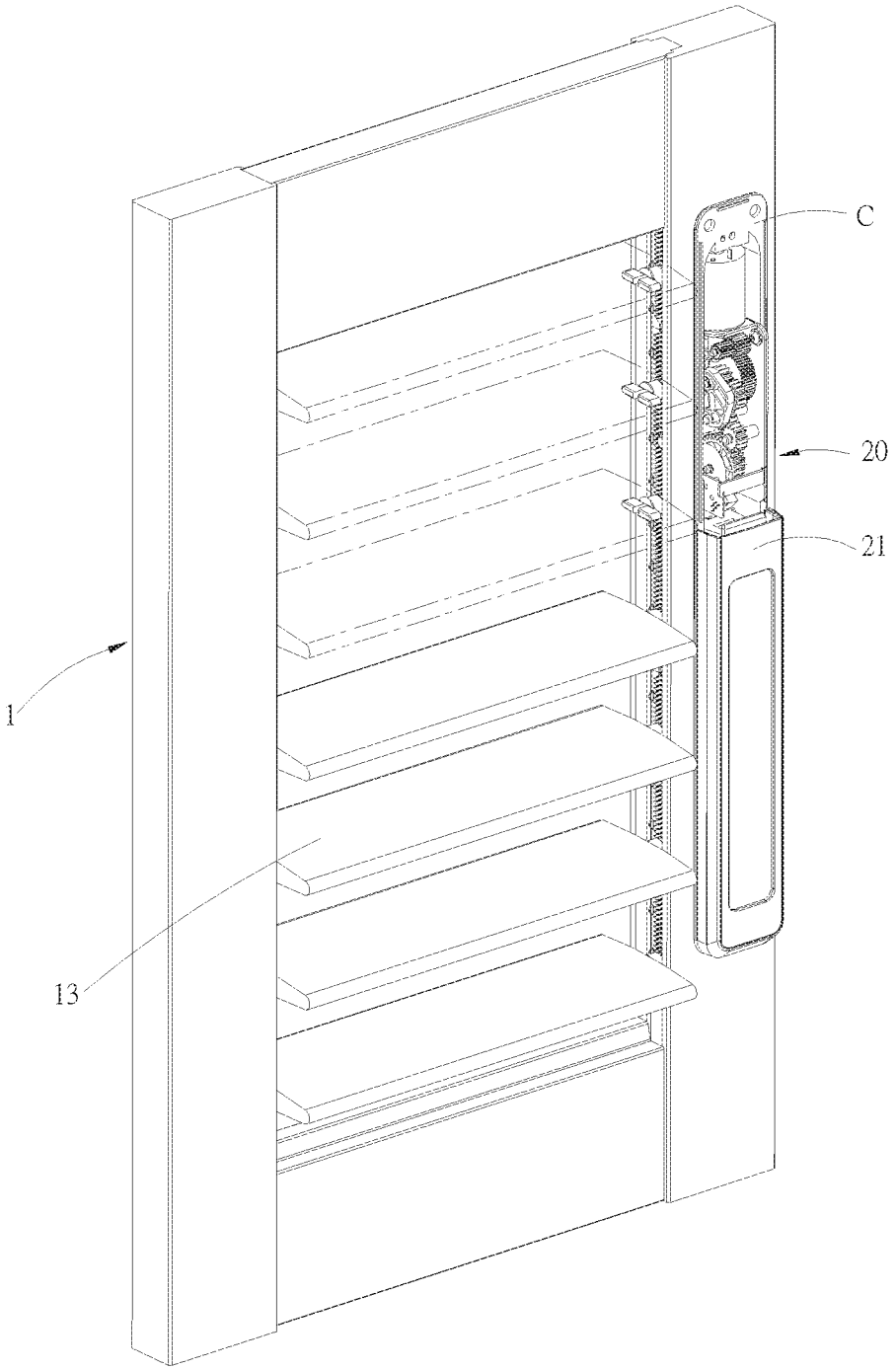
FIG. 4 is a perspective view, showing the control system of the first embodiment accommodated in the shutter.
Figure 5:
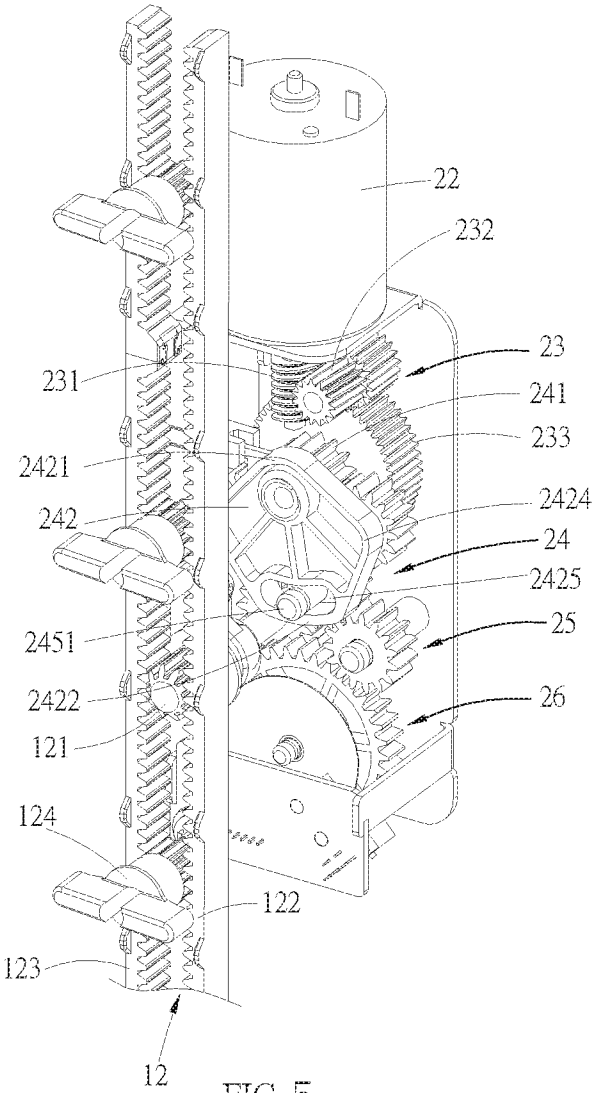
FIG. 5 is a perspective view, showing the control system of the first embodiment and the force-bearing mechanism of the shutter.
Figure 6:
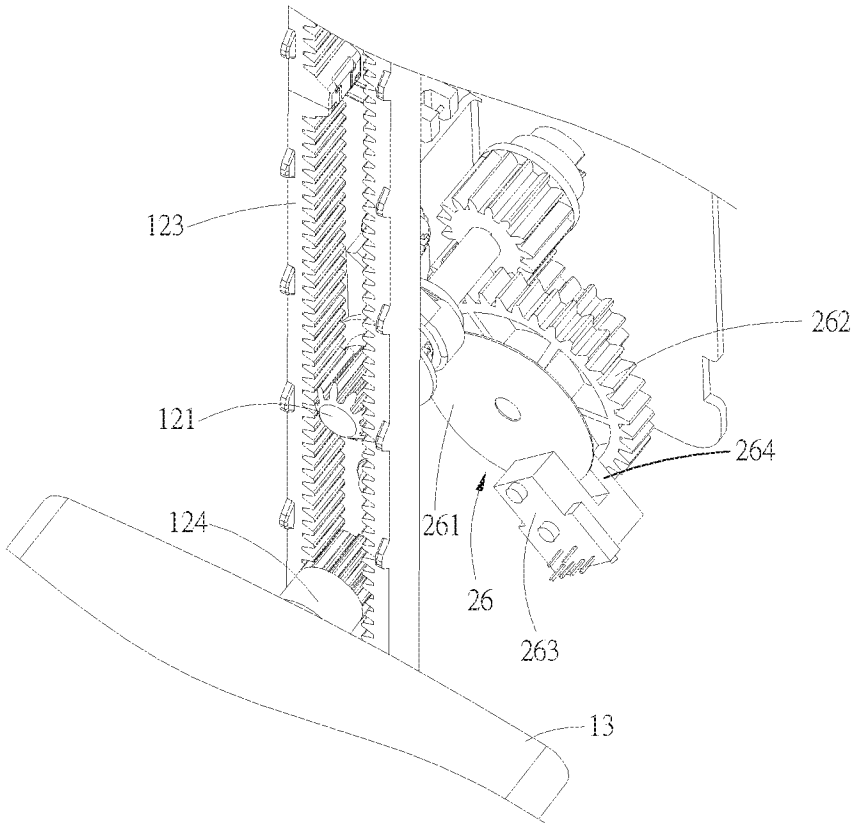
FIG. 6 is a perspective view, showing the position detection mechanism of the control system of the first embodiment and the force-bearing mechanism of the shutter.

A shutter 1 suitable for using the control system disclosed in the present disclosure is illustrated in FIG. 1 to FIG. 5, wherein the arrangement of a control system 20 of a first embodiment of the present disclosure in the shutter 1 is specifically illustrated in FIG. 3 to FIG. 5. The shutter 1 is installed in a window frame W, wherein the shutter 1 includes a frame 11, a force-bearing mechanism 12, and a plurality of slats 13. The frame 11 includes a top beam 111, a bottom beam 112 and two posts 113. The top beam 111 is positioned parallel to the bottom beam 112. The two posts are positioned between the top beam 111 and the bottom beam 112, and one end of each of the posts 113 is connected the top beam 111 while the other end thereof is connected the bottom beam 112, whereby to form the frame 11. One of the posts 113 is pivotally positioned at the window frame W, so that the shutter 1 is able to be pivoted toward or away from the window frame W, whereby to cover or expose an opening of a building. The slats 13 are parallel to the top beam 111 and the bottom beam 112, and are positioned therebetween. Each of the slats 13 is fixedly provided between the two posts 113 in a turnable manner. The force-bearing mechanism 12 is positioned in one of the two posts 113, and is adapted to drive the slats 13 to turn, wherein the post 113 which accommodates the force-bearing mechanism 12 has a surface facing the slats 13, and the surface is defined as an adjacent surface 1131.

The force-bearing mechanism 12 is a rack-and-opinion mechanism, which includes an output shaft 121, a first toothed rack 122, a second toothed rack 123 and a plurality of pivoting axles 124. The first toothed rack 122 and the second toothed rack 123 are parallel to each other, and are positioned in the longitudinal direction of one of the posts 113 of the shutter 1. Furthermore, the first toothed rack 122 and the second toothed rack 123 are close to the adjacent surface 1131 of the post 113 in which the force-bearing mechanism 12 is positioned. The output shaft 121 and the pivoting axles 124 are positioned between the first toothed rack 122 and the second toothed rack 123, and all mesh with the first rack 122 and the second rack 123. Each of the pivoting axles 124 is fixedly connected to an end of one of the slats 13. When the output shaft 121 is driven to rotate, the first toothed rack 122 and the second toothed rack 123 meshing with the output shaft 121 would be moved relative to each other in accordance with the rotation direction of the output shaft 121. The relative movement of the first toothed rack 122 and the second toothed rack 123 would rotate the pivoting axles 124, whereby to rotate the slats 13, whereby, the slats 13 could be turned to adjust the tilt angle thereof. When the shutter 1 covers the opening of the building, the amount of light passing through the opening could be adjusted by tilting the slats 13. For example, the slats 13 illustrated in FIG. 1 are in a shielding state, in which the slats 13 are turned to block light from entering the building; the slats 13 illustrated in FIG. 2 are in an opening state, in which the slats 13 are operated to a horizontal position, allowing light to enter the building.

Figure 1:
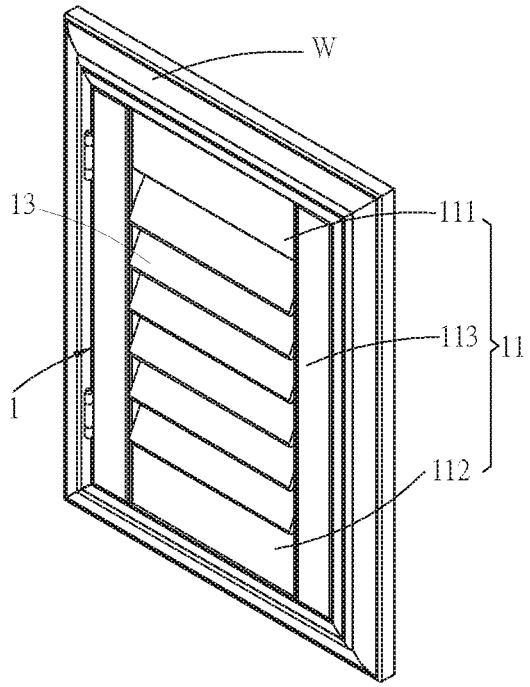
FIG. 1 is a perspective view of a shutter applied with the control system of the present disclosure, in which the slats of the shutter are closed.

FIG. 3 and FIG. 4 are other perspective views of the shutter 1, showing the other side of the shutter 1 opposite to the views in FIG. 1 and FIG. 2. In FIG. 3 and FIG. 4, the side of the shutter 1 corresponds to the opening, and faces outside of the building. The control system 20 of the first embodiment of the present disclosure is positioned at one of the posts 113, which has a solar panel S provided thereon, wherein the control system 20 includes a battery pack which is rechargeable through the solar panel S to provide electricity needed for electrically adjusting the tilt angle of the slats 13. Besides, in the present embodiment, the control system 20 is positioned in a shell C to be modularized, whereby it is convenient to install the control system 20 into the corresponding post 113 of the shutter 1.

The control system 20 of the first embodiment of the present disclosure is illustrated in FIG. 3 to FIG. 9, which includes an electric power member 21, a first actuator 22, a deceleration mechanism 23, a swing mechanism 24, a transmission assembly 25 and a position detection device 26. The electric power member 21 is adapted to provide power to the first actuator 22 for its operation. In the current embodiment, the electric power member 21 is a battery pack rechargeable by the solar panel S; in other embodiments, the electric power member 21 could use mains electricity as well. When the first actuator 22 is operating, a first driving shaft 221 of the first actuator 22 provides a first driving force with a rotation speed, wherein the first driving force is adapted to drive the force-bearing mechanism 12 to turn the slats 13. The first actuator 22 and the deceleration mechanism 23 are connected and operated with each other correspondingly. The deceleration mechanism 23, which is a gear deceleration mechanism, includes a worm 231, a worm gear 232 and a connecting gear 233, wherein the worm 231 is coaxially fixed to the first driving shaft 221 of the first actuator 22, so that the worm 231 could be rotated by the first shaft 221; the worm 231 meshes with the worm gear 232, and the worm gear 232 meshes with the connecting gear 233. In the current embodiment, the numbers of the teeth of the worm 232, the worm gear 232, and the connecting gear 233 are different from each other. With the different teeth ratios between these components, the gear deceleration mechanism 23 could reduce the rotation speed of the first driving force when the first actuator 22 outputs the first driving force, whereby to increase the strength of the first driving force passing through the gear deceleration mechanism 23.

Figure 7:
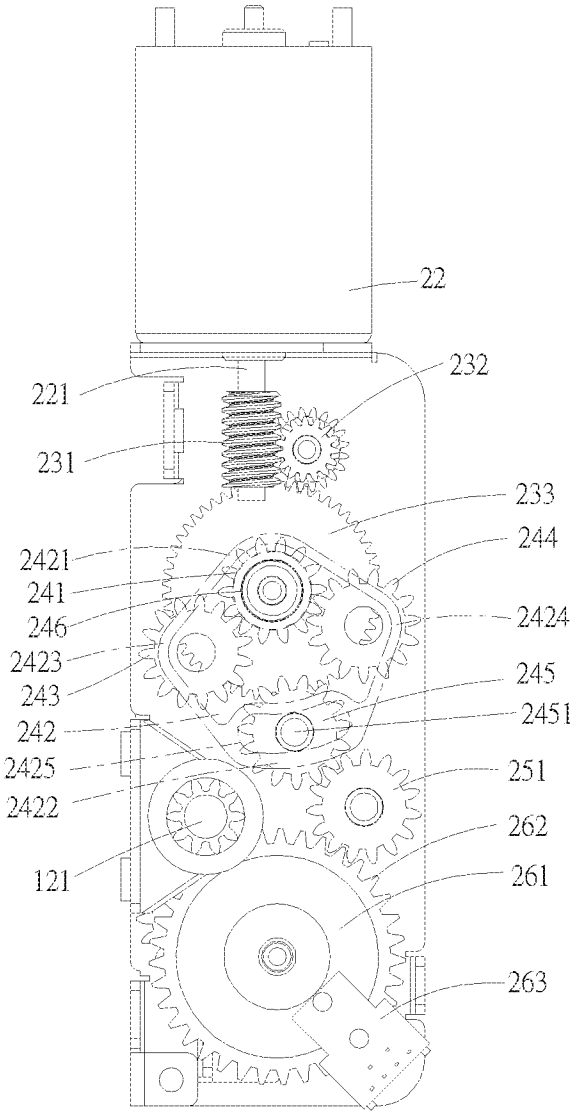
FIG. 7 is a schematic plan view, showing the condition when the control system of the first embodiment is not in operation.
Figure 8:
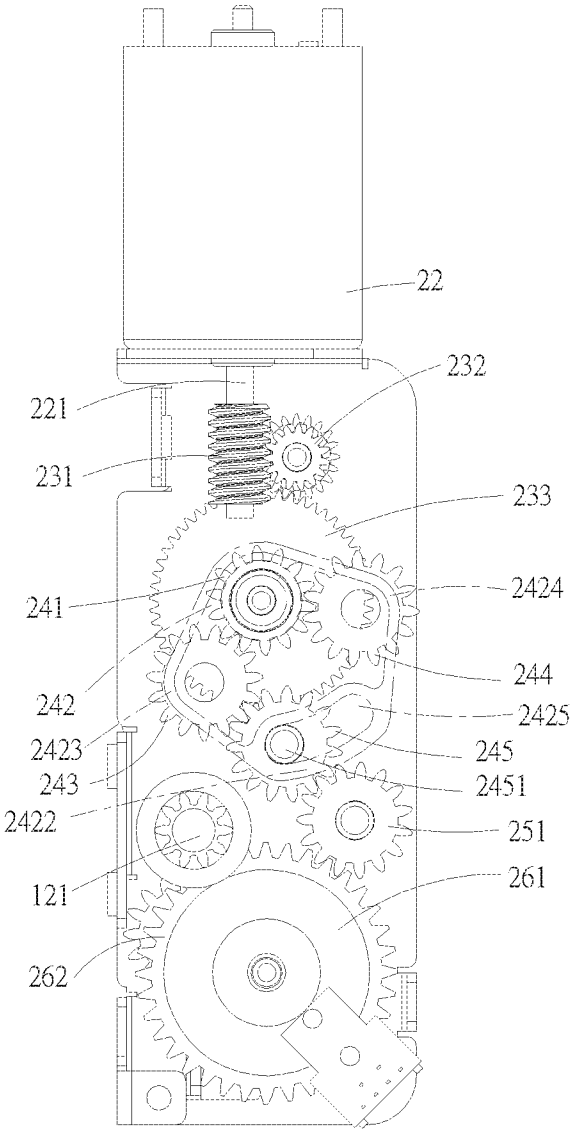
FIG. 8 and FIG. 9 are schematic plan views, showing the condition when the control system of the first embodiment is in operation.
Figure 9:
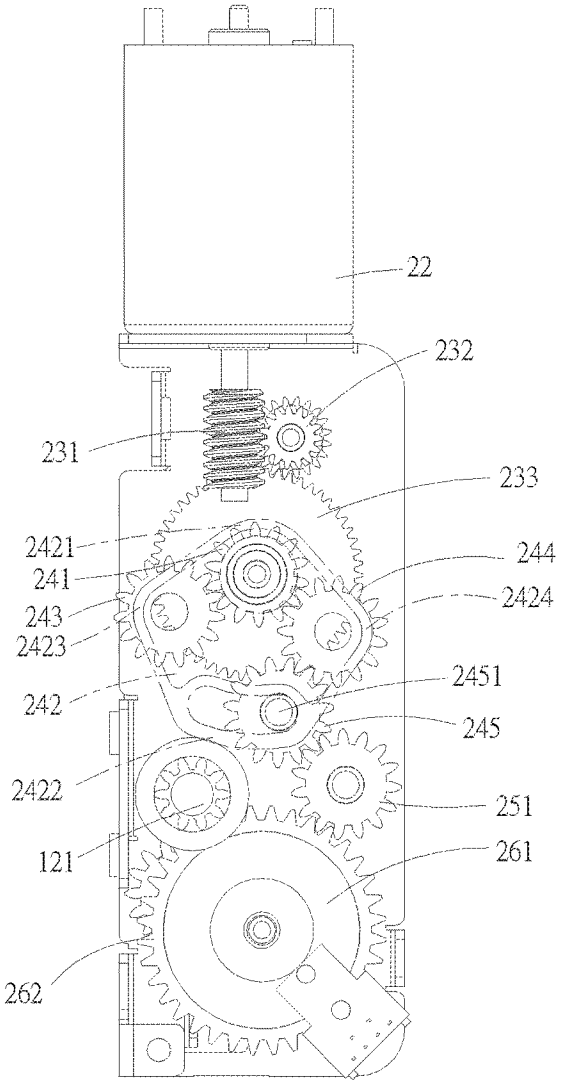
Figure 10:
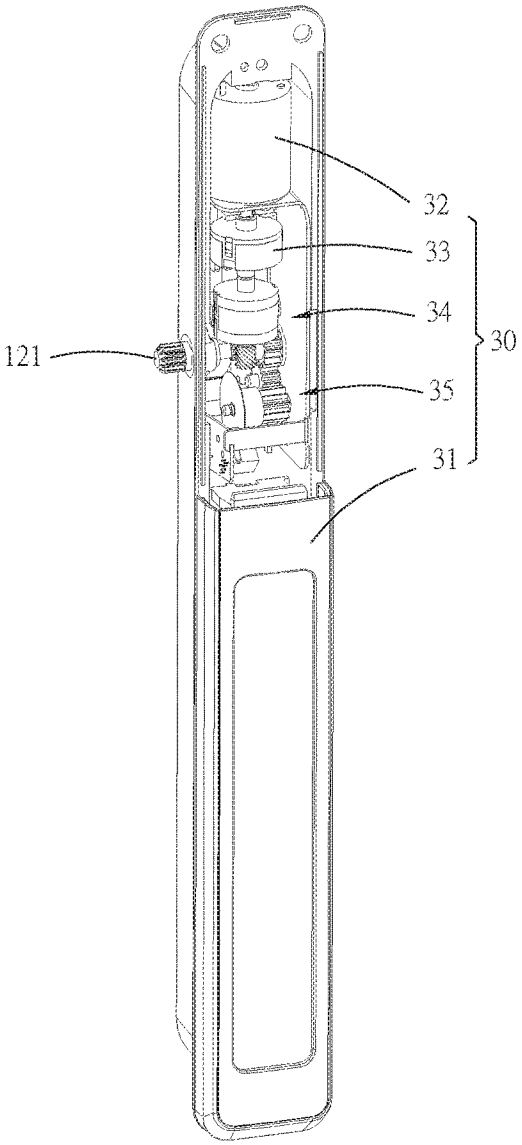
FIG. 10 is a perspective view, showing the whole control system of a second embodiment.
Figure 11:
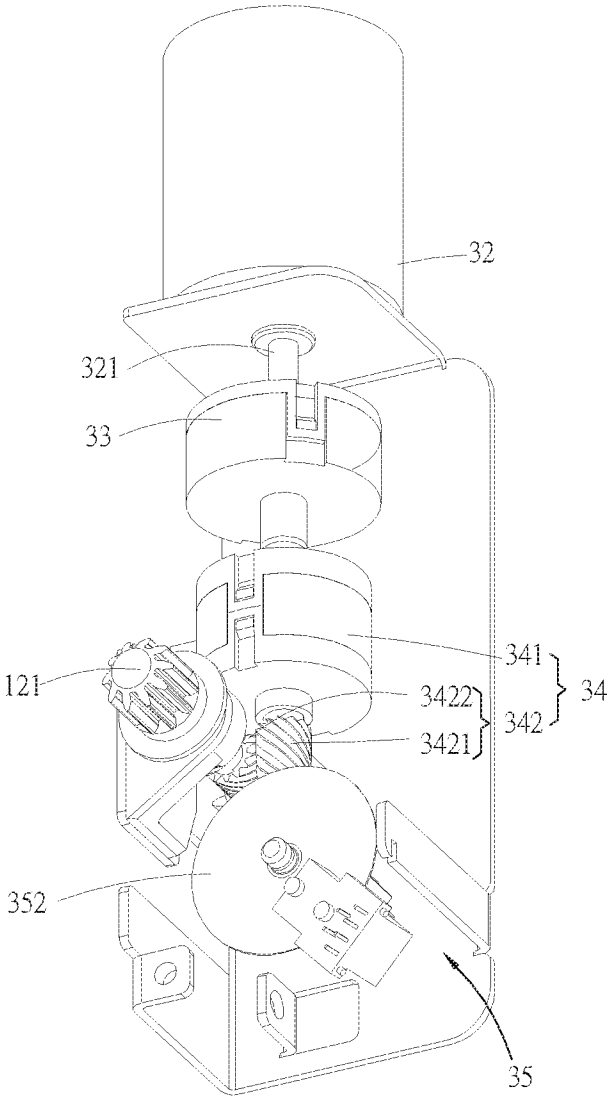
FIG. 11 is a perspective view, showing part of the control system of the second embodiment.
Figure 12:
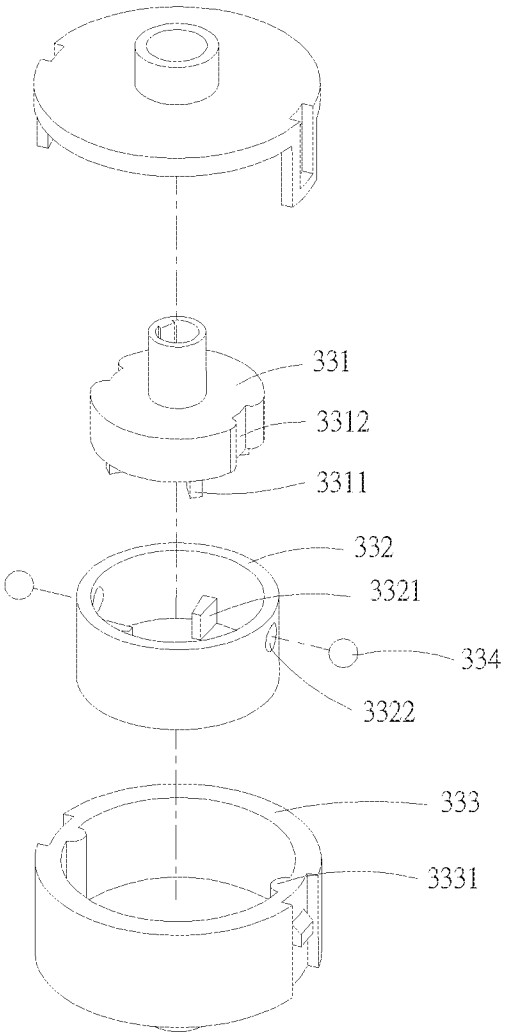
FIG. 12 an exploded view, showing the ball mechanism of the second embodiment.
Figure 13:
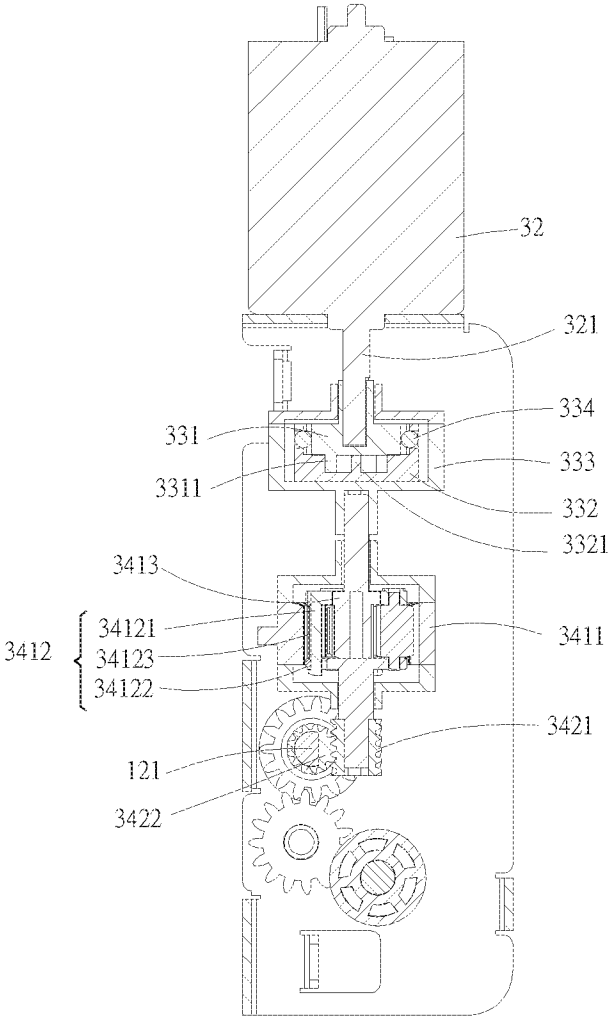
FIG. 13 is a partial sectional view, showing the condition when the control system of the second embodiment is not linked to the force-bearing mechanism.
Figure 14:
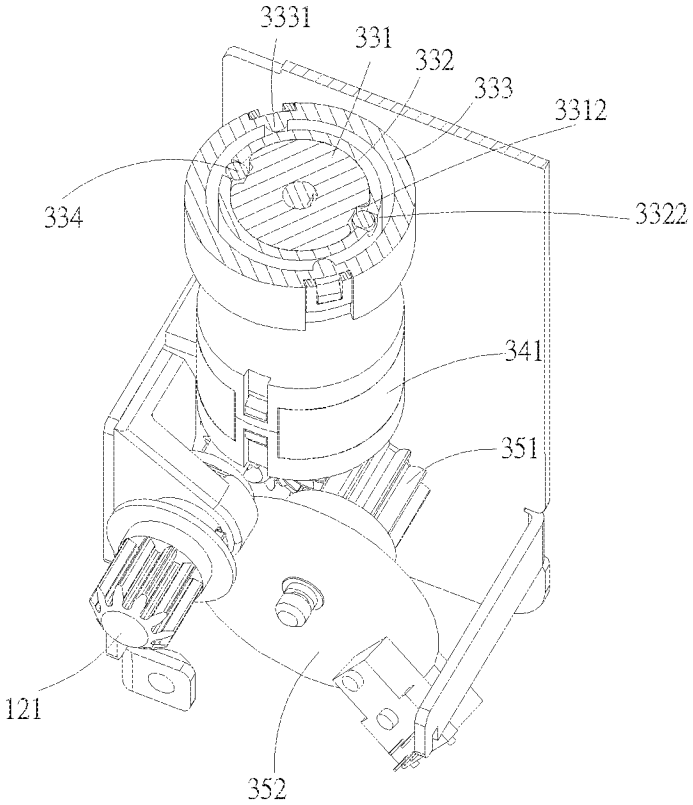
FIG. 14 is another sectional view viewed in another angle, also showing the condition when the control system of the second embodiment is not linked to the force-bearing mechanism.
Figure 15:
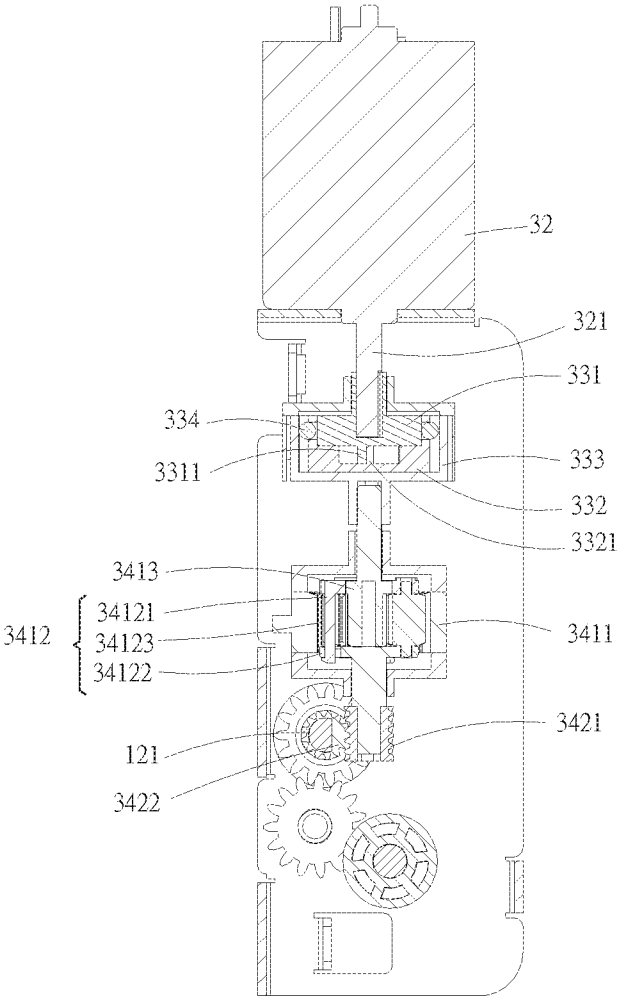
FIG. 15 is a partial sectional view, showing the condition when the control system of the second embodiment is linked to the force-bearing mechanism.

The swing mechanism 24 will be driven concurrently along with the movement of the connecting gear 233 of the gear deceleration mechanism 23, wherein the swing mechanism 24 includes a central gear 241, a swing arm 242, a first transmission gear 243, a second transmission gear 244, an engaging gear 245 and a fixed spring 246. The central gear 241 is coaxially fixed to the connecting gear 233. The swing arm 242 includes a first end 2421, a second end 2422, a third end 2423 and a fourth end 2424, wherein the second end 2422 is opposite to the first end 2421; the third end 2423 and the fourth end 2424 are provided between the first end 2421 and the second end 2422, and are opposite to each other. The fixed spring 246 is fixed between the central gear 241 and the first end 2421 of the swing arm 242. The first transmission gear 243 is positioned at the third end 2423, and the second transmission gear 244 is positioned at the fourth end 2424. The first transmission gear 243 and the second transmission gear 244 respectively mesh with the central gear 241, and the engaging gear 245 is positioned at the second end 2422. Accordingly, when the first actuator 22 rotates the connecting gear 233 to synchronously rotate the central gear 241 through the fixed spring 246, the swing arm 242 would be consequently pivoted about the first end 2421 (i.e., the first end 2421 works as a pivot axis for the swing arm 242) in a first pivoting direction or a second pivoting direction, whereby, the engaging gear 245 could either selectively mesh with one of the first transmission gear 243 and the second transmission gear 244, as shown in FIG. 8 and FIG. 9, or both disengages from the first transmission gear 243 and the second transmission gear 244, as shown in FIG. 7. In addition, the second end 2422 further includes a positioning member 2425, wherein an axle 2451 of the engaging gear 245 is received in the positioning member 2425, so that the movement of the second end 2422 is limited, and therefore the pivoting range of the swing arm 242 is also limited. In the current embodiment, the fixed spring 246 is fixed between the central gear 241 and the first end 2421. When the first actuator 22 rotates the connecting gear 233, the connecting gear 233 would rotate the central gear 241 through the fixed spring 246 at the same time, and would also pivot the swing arm 242. When the swing arm 242 is pivoted to a position where the engaging gear 245 meshes with the first transmission gear 243 or the second transmission gear 244, and when the pivoting range of the swing arm 242 is limited, the fixed spring 246 and the swing arm 242 would slide against each other. As a result, the swing arm 242 would be no longer pivoted by the fixed spring 246, and would stay at a specific position. However, the location of the fixed spring is not limited as described above. In other embodiments, there could be two fixed springs 246, one of which is fixed between the first transmission gear 243 and the third end 2423 of the swing arm 242, while the other one is fixed between the second transmission gear 244 and the fourth end 2424 of the swing arm 242. Such design could operate and position the swing arm 242 as well.

The transmission assembly 25 at least includes a driving gear 251 which meshes with the engaging gear 245. The position detection device 26 will be driven concurrently along with the movement of the transmission assembly 25. In the current embodiment, the position detection device 26 is an optical position detection device, and includes an encoder disk 261, an encoder gear 262, a light source 263 and an optical sensor 264. The encoder disk 261 and the encoder gear 262 are coaxially fixed, and could rotate synchronously. The encoder gear 262 also meshes with the driving gear 251 of the transmission assembly 25. The light source 263 and the optical sensor 264 correspond to each other, and are positioned respectively on opposite sides of the encoder disk 261, so that the encoder disk 261 could rotate between the light source 263 and the optical sensor 264. Furthermore, when the encoder disk 261 rotates, the light emitted from the light source 263 could pass through code holes on the encoder disk 261, and then the optical sensor 264 could receive different coded signals representing different rotary positions. Additionally, the encoder gear 262 further meshes with the output shaft 121 of the force-bearing mechanism 12. When the output shaft 121 is driven to rotate, i.e., when the tilt angle of the slats 13 is changed, the encoder gear 262 would be rotated to correspondingly change the coded signal representing the current rotary position of the output shaft 121.

As shown in FIG. 4 to FIG. 7, the first actuator 22 is idle when the control system 20 is not actuated, so the swing arm 242 is not driven to pivot. In more details, the first transmission gear 243 pivoted at the third end 2423 of the swing arm 242 and the second transmission gear 244 pivoted at the fourth end 2424 of the swing arm 242 are both disengaged from the engaging gear 245. In this condition, if one of the slats 13 is turned manually, the pivoting axle 124 fixed at the end of the turned slat 13 would be driven to rotate as well, so that the first toothed rack 122 and the second toothed rack 123 are driven to move relative to each other. Furthermore, the relative movement of the first toothed rack 122 and the second toothed rack 123 would also drive the output shaft 121 to rotate, whereby to drive the encoder gear 262 meshing with the output shaft 121 to rotate at the same time. When the encoder gear 262 rotates, the driving gear 251 and the engaging gear 245 would be driven to rotate by the encoder gear 262. However, the rotation of the engaging gear 245 would not drive the gear deceleration mechanism 23 and the first actuator 22 to work, for both of the first transmission gear 243 and the second transmission gear 244 are disengaged from the engaging gear 245. Therefore, the slats 13 would not be hindered by the idle first actuator 22, and could be freely turned by hand. Besides, when the encoder gear 262 rotates, the encoder gear 262 would rotate the encoder disk 261, and therefore the current tilt angle of the slats 13 in accordance with the rotation of the slats 13 could be represented through the code holes on the encoder disk 261.

As shown in FIG. 4 to FIG. 9, when the electric power member 21 provides power to the first actuator 22 to rotate the first driving shaft 221, the outputted first driving force would rotate the worm 231, the worm gear 232, and the connecting gear 233 of the gear deceleration mechanism 23. As a result, the strength and the rotation speed of the first driving force passing through the gear deceleration mechanism 23 would be both changed, whereby to generate adequate rotation speed and torque needed for turning the slats 13. The first actuator 22 could output the first driving force in different rotation directions through the first driving shaft 221. In the condition illustrated in FIG. 8, the connecting gear 233 is rotated, which also drives the central gear 241 to rotate, whereby to drive the swing arm 242 to pivot in the first pivoting direction with the first end 2421 used as an axis. Consequently, the first transmission gear 243 provided at the third end 2423 would be moved in the first pivoting direction to mesh with the engaging gear 245. In this way, the first driving force could be applied to the transmission assembly 25 through the first transmission gear 243 and the engaging gear 245, whereby to drive the encoder gear 262 and the output shaft 121 to rotate. The rotation of the output shaft 121 would drive the first toothed rack 122 and the second toothed rack 123 to move relative to each other, consequently turning the slats 13. Before the control system 20 stops operating, the electric power member 21 has to drive the first actuator 22 to output a second rotating force, of which the rotation direction is opposite to the current rotation direction of the first driving force, whereby the second rotating force would drive the swing arm 242 to pivot in the second pivoting direction. The control system 20 would not stop operating until the first transmission gear 243 is disengaged from the engaging gear 245. Once the first transmission gear 243 is disengaged from the engaging gear 245, the operation of the control system 20 could be stopped. At this time, the control system 20 goes back to its original state, in which the slats 13 could be turned manually. When the encoder gear 262 rotates, the encoder disk 261 would be concurrently driven to rotate by the encoder gear 262. As a result, the encoder disk 261 could be rotated along with the tuning of the slats 13, whereby to correspondingly change the code hole on the encoder disk 261 at the position corresponding to the light source 263.

Similarly, in the condition illustrated in FIG. 9, the first actuator 22 is driven to provide the first driving force in another rotation direction to pivot the swing arm 242 in the second pivoting direction with the first end 2421 thereof used as an axle. Therefore, the second transmission gear 244 positioned at the fourth end 2424 would be moved in the second pivoting direction to mesh with the engaging gear 245. Whereby, the second rotating force could be transmitted to the transmission assembly 25 through the second transmission gear 244 and the engaging gear 245, and could consequently drive the encoder gear 262 and the output shaft 121 to rotate. The rotation of the output shaft 13 could drive the first toothed rack 122 and the second toothed rack 123 to move relative to each other, whereby to turn the slats 13. After that, the first actuator 22 would provide the second rotating force, of which the rotation direction is opposite to the current rotation direction of the first driving force before the control system 20 stops operating, so that the swing arm 242 would be pivoted reversely in the first pivoting direction until the second transmission gear 244 is disengaged from the engaging gear 245. Once the second transmission gear 244 is disengaged from the engaging gear 245, the operation of the control system 20 could be stopped. At the moment, the control system 20 goes back to the original state, in which the slats 13 could be turned manually again. Similarly, when the encoder gear 262 rotates, the encoder disk 261 would be concurrently driven to rotate by the encoder gear 262, whereby the encoder disk 261 could be rotated along with the tuning of the slats 13 to correspondingly change the positions of the code holes on the encoder disk 261. When the slats 13 are going to be rotated in an electric mode again, the position detection device 26 could obtain the correct position signal representing the current tilt angle of the slats 13. Whereby, the control system 20 could determine the current position of the slats 13, and therefore could drive the first actuator 22 to turn the slats 13 to a required angle.

With the arrangement of the control system 20, the swing arm 24 could establish a force transmission route between the first actuator 22 and the output shaft 121 of the force-bearing mechanism 12 while the first actuator 22 outputs the first driving force, so that the first driving force could drive the slats 13 to rotate through the swing mechanism 24. On the contrary, when the first actuator 22 of the control system 20 completely stops operating, the slats 13 could be turned freely without being confined by the first actuator 22, for the swing arm 24 has disconnected the force transmission route between the first actuator 22 and the force-bearing mechanism 12. Therefore, the establishment and disconnection of the force transmission route is determined by whether the first actuator 22 is in operation or not; in other words, there is no need to manually switch between the establishment and disconnection of the force transmission route. Therefore, the driving mode for turning the slats 13 (i.e., by electric means or by hand) could be switched automatically.

Figure 16:
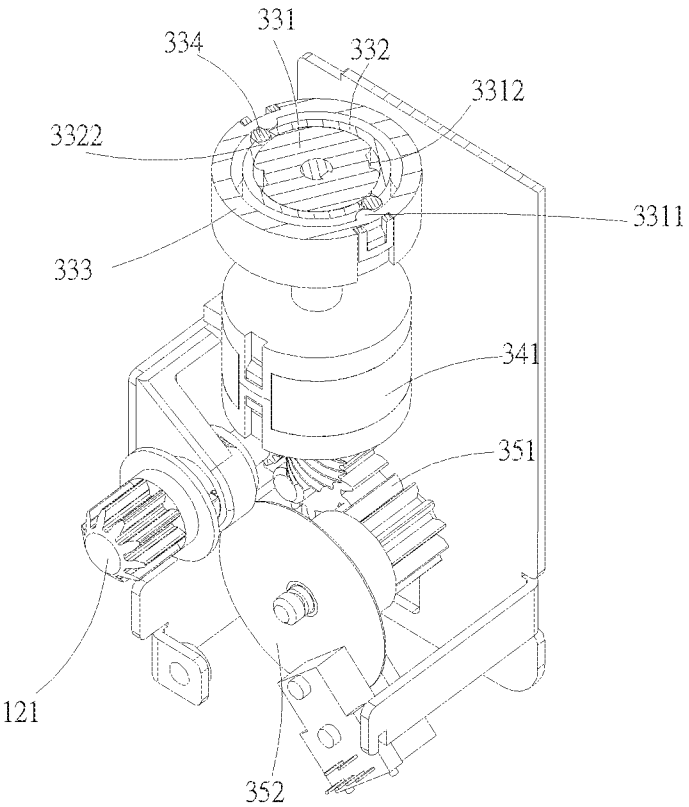
FIG. 16 is a sectional perspective view viewed in another angle, also showing the condition when the control system of the second embodiment is linked to the force-bearing mechanism.
Figure 17:
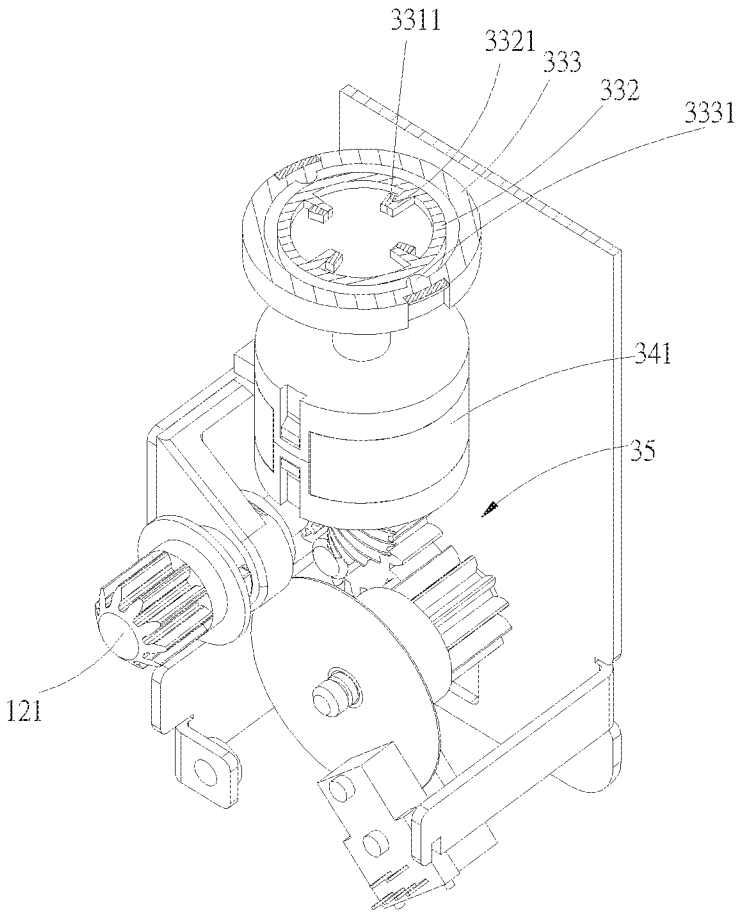
FIG. 17 is a sectional perspective view viewed in the same angle with FIG. 16, but with a different cross-sectional depth, also showing the condition when the control system of the second embodiment is linked to the force-bearing mechanism.
Figure 18:
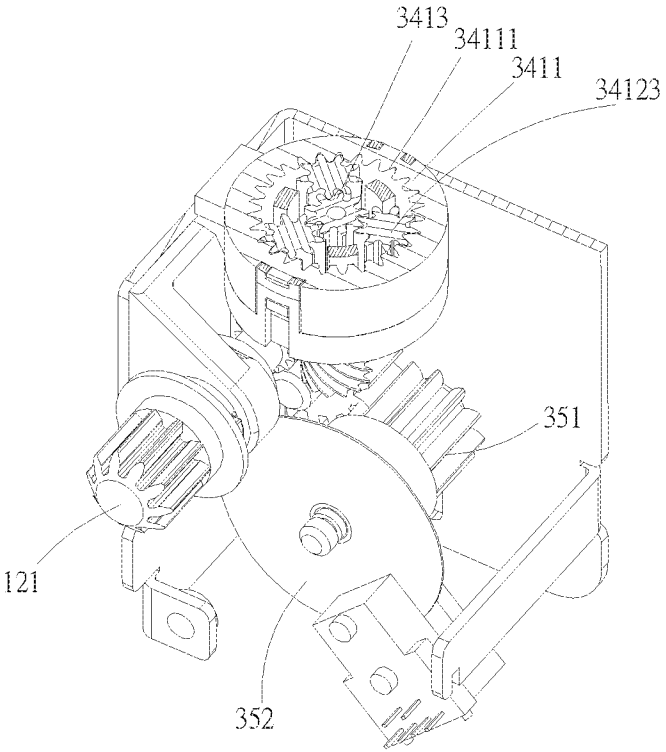
FIG. 18 is a sectional perspective view, showing that the deceleration mechanism of the control system of the second embodiment.
Figure 19:
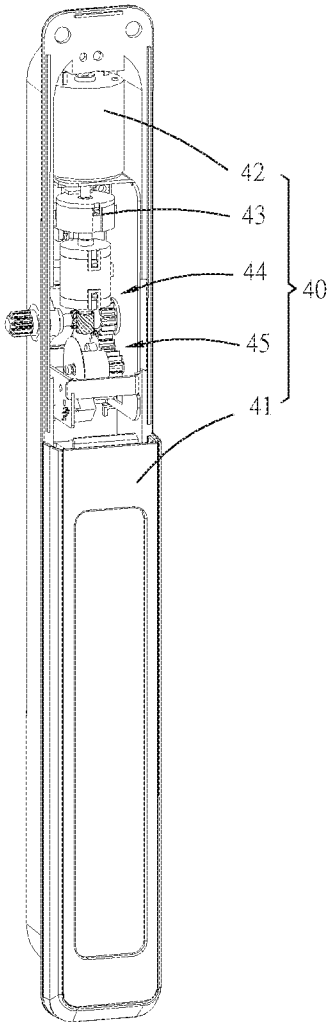
FIG. 19 is a perspective view, showing the whole control system of a third embodiment.
Figure 20:
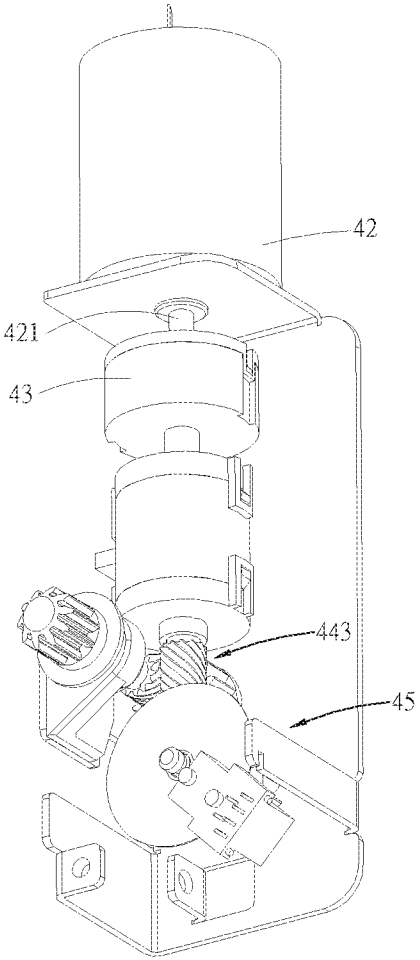
FIG. 20 is a perspective view, showing part of the control system of the third embodiment.
Figure 21:
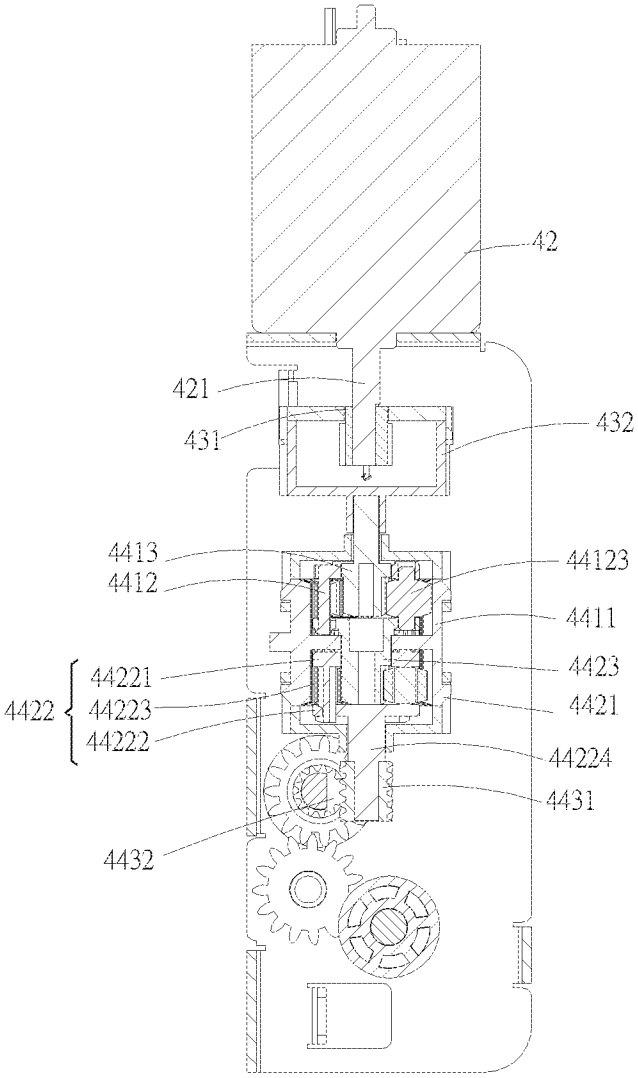
FIG. 21 is a partial sectional view, showing the control system of the third embodiment.
Figure 22A:
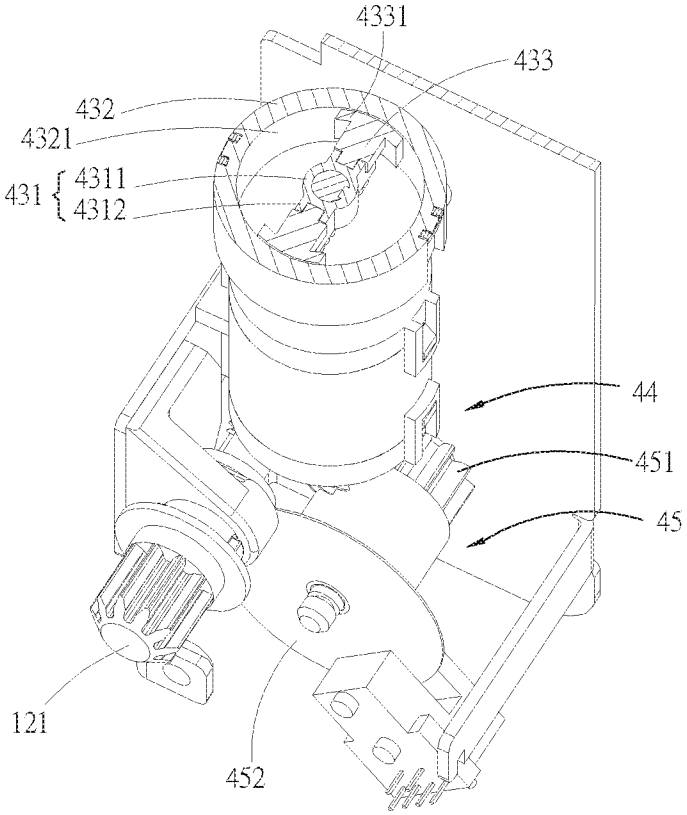
FIG. 22A is a sectional perspective view, showing a centrifugal mechanism of the third embodiment.
Figure 22B:
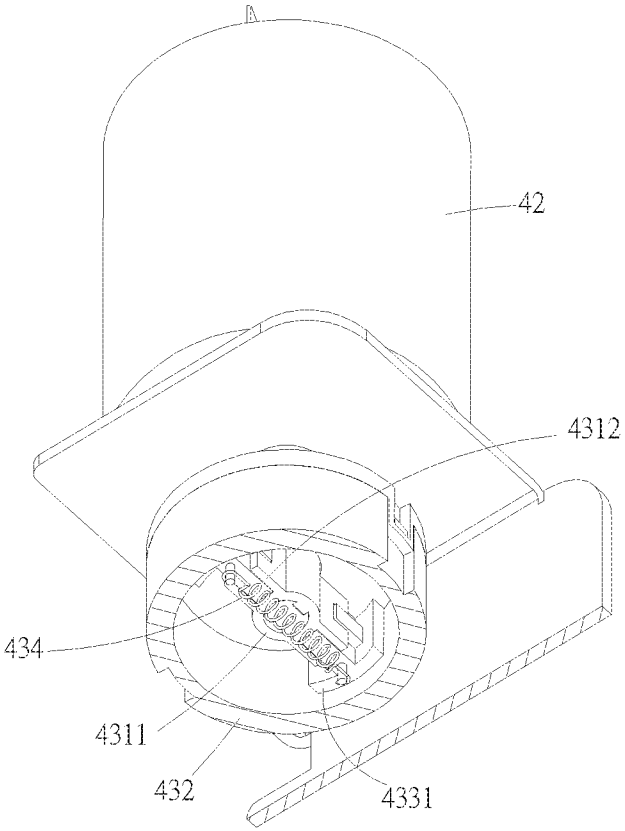
FIG. 22B is a sectional perspective view viewed in another angle, showing the centrifugal mechanism of the third embodiment.
Figure 23:
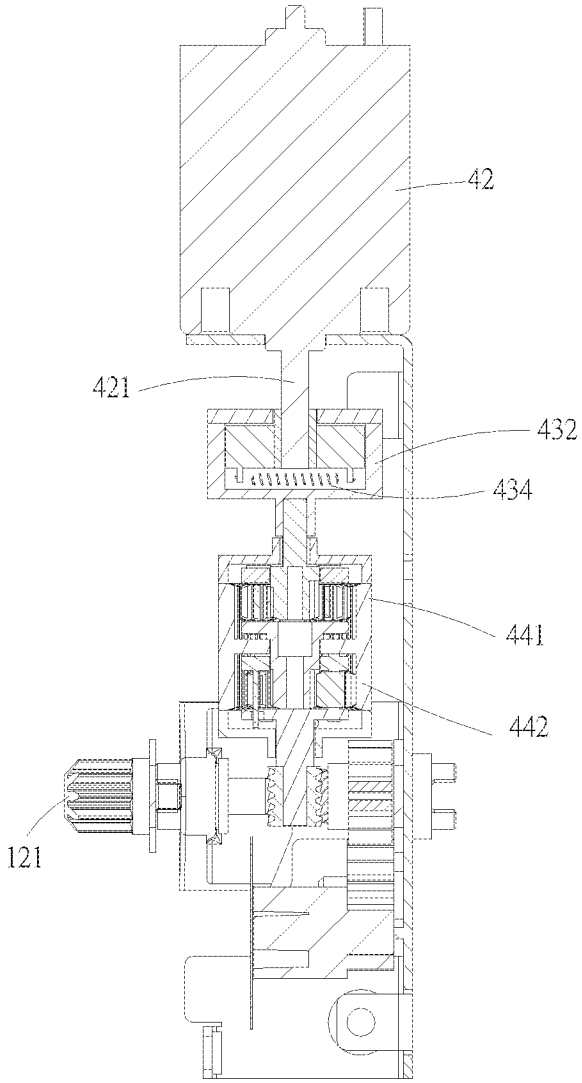
FIG. 23 is a sectional view viewed in another angle, showing part of the control system of the third embodiment.
Figure 24:
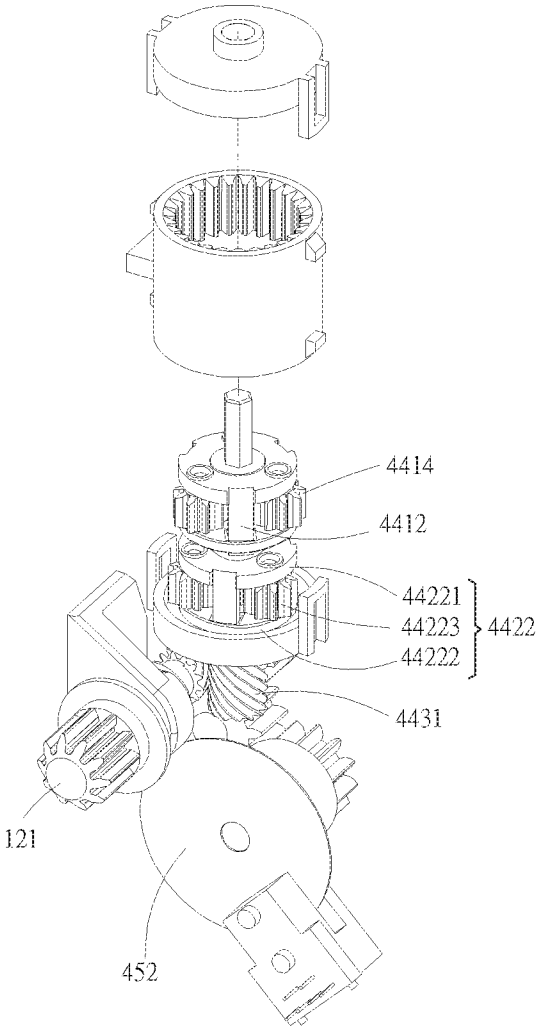
FIG. 24 is a partial exploded view, showing the deceleration mechanism of the control system of the third embodiment.

A control system 30 of a second embodiment of the present disclosure is illustrated in FIG. 10 to FIG. 18, which includes an electric power member 31, a first actuator 32, a ball mechanism 33, a deceleration mechanism 34 and a position detection device 35. Similar to the previous embodiment, the electric power member 31 provides power to operate the first actuator 32, and the first actuator 32 would provide a first driving force while in operation. The ball mechanism 33 includes a rotating body 331, an inner base 332, an outer base 333 and at least one ball 334, wherein the rotating body 331, the inner base 332 and the outer base 333 are rotatable, and are coaxially fitted around by one another from inside to outside sequentially. In the current embodiment, the rotating body 331 is fixedly connected to the first driving shaft 321 of the first actuator 32; a surface of the rotating body 331 facing the inner base 332 has at least one bump 3311 provided thereon, and a surface of the inner base 332 facing the rotating body 331 has at least one blocker 3321 coordinating with the bump 3311. When the bump 3311 of the rotating body 331 abuts against the blocker 3321 of the inner base 332, the rotating body 331 could rotate the inner base 332, as shown in FIG. 17. The inner base 332 has at least one opening 3322 communicating the rotating body 331 and the outer base 333, and the ball 334 is inserted into the opening 3322, so that the ball 334 could roll along with the rotation of the inner base 332. The radial surface of the rotating body 331 has at least one groove 3312 which corresponds to the opening 3322 of the inner base 332. When the groove 3312 aligns with the opening 3322, the ball 334 would fall into the space formed between the groove 3312 and the opening 3322, and an outer surface of the ball 334 would not exceed the rim of the opening 3322 facing the outer base 333. An inner surface of the outer base 333 has at least one rib 3331 provided thereon, wherein the rib 3331 corresponds to the ball 334, so that a width of a gap between the outer base 333 and the inner base 332 at least equals to a thickness of the rib 3331.

In the current embodiment, the deceleration mechanism 34 is a planetary gear deceleration system, including a single deceleration assembly 341 and a worm assembly 342. The single deceleration assembly 341 includes a first ring gear 3411, a first planetary carrier 3412, and a first sun gear 3413. The worm assembly 342 includes a worm 3421 and a worm wheel 3422. The first ring gear 3411, the first planetary carrier 3412, and the first sun gear 3413 are coaxially fitted. The first ring gear 3411 has an inner toothed surface 34111. The planetary carrier 3412 fits in the first ring gear 3411, and two sides of the first planetary carrier 3412 are respectively a first surrounded portion 34121 and a second surrounded portion 34122. A plurality of first planetary gears 34123 are positioned between the first surrounded portion 34121 and the second surrounded portion 34122. The first sun gear 3413 fits in the first surrounded portion 34121, and is positioned between the first planetary gears 34123, so that the first planetary gears 34123 are positioned between the first ring gear 3411 and the first sun gear 3413. Each of the first planetary gears 34123 meshes with the sun gear 3413 and the inner toothed surface 34111 of the first ring gear 3411, respectively. The first sun gear 3413 is fixedly connected to the outer base 333, whereby to be rotated by the outer base 333. The first planetary carrier 3412 has a first protruded axle 34124 protruded from the second surrounded portion 34122, wherein the worm 3421 of the worm assembly 342 is coaxially fixed to the first protruded axle 34124, so that the worm 3421 could be driven by the first protruded axle 34124. The worm wheel 3422 meshes with the worm 3421. When the first sun gear 3413 is rotated by the outer base 333, each of the first planetary gears 34123 is rotated by the first sun gear 3413 as meshing with the first sun gear 3413, so that each of the first planetary gears 34123 would also rotate about its own axis, and revolve along the inner toothed surface 34111 of the first ring gear 3411. Therefore, the first planetary carrier 3412 would be rotated along with the rotation of the first planetary gears 34123 and the first sun gear 3413, whereby to reduce the rotation speed. In addition, the rotation speed could be further reduced, for the first planetary carrier 3412 could drive the worm 3421 and the worm wheel 3422 to rotate. With such arrangement of the planetary gear deceleration mechanism 34, the strength and the rotation speed of the first driving force transmitted to the worm wheel 3422 could be changed.

The worm wheel 3422 and the output shaft 121 of the force-bearing mechanism 12 are coaxially provided; when the worm wheel 3422 rotates, the output shaft 121 would be rotated by the worm wheel 3422. The output shaft 121 meshes with the encoder gear 351 of the position detection device 35, in order to rotate the encoder gear 351 and the encoder disk 352 to record the current tilt angle of the slats 13. In the current embodiment, the operating principle of the position detection device 35 is the same as that of the first embodiment; both of them are optical position detection devices, so the details about the position detection device 35 in the current embodiment would not be described again herein.

As shown in FIG. 13 to FIG. 17, when the first actuator 32 outputs the first driving force through the first driving shaft 321, the rotating body 331 of the ball mechanism 33 is driven by the first driving force to rotate related to the inner base 332. When the rotating body 331 rotates, the grooves 3312 of the rotating body 331 would be moved along with the rotation of the rotating body 331, so that the groove 3312 does not align with the opening 3322 of the inner base 332. At the same time, the ball 334 would be pushed outward by the rotating body 331 to be moved in the radial direction of the rotating body 331, which would make a part of the ball 334 protrude from the rim of the opening 3322 facing the outer base 333, as shown in FIG. 16. When the rotating body 331 keeps rotating to abut the bump 3311 of the rotating body 331 against the blocker 3321 of the inner base 332, the rotating body 331 could drive the inner base 332 to rotate together, and the ball 334 accommodated within the opening 3322 of the inner base 332 would be moved along with the rotation of the inner base 332. When the ball 334 is moved to abut against the rib 3331 of the outer base 333, the outer base 333 would be driven by the inner base 332 to rotate. At the moment, the rotating body 331, the inner base 332 and the outer base 333 would rotate synchronously in the same direction. Since the outer base 333 could drive the planetary gear deceleration mechanism 34 to rotate, the rotation speed of the first driving force would be decreased after passing through the planetary gear deceleration mechanism 34, whereby the force-bearing mechanism 12 could be driven with a proper strength and proper rotation speed to turn the slats 13.

Before the control system 30 stops operating, the first actuator 32 outputs the second rotating force, of which the rotation direction is opposite to that of the first driving force, to drive the rotating body 331 to rotate reversely. The reverse rotation of the rotating body 331 would separate the bump 3311 of the rotating body 331 from the blocker 3321 of the inner base 332, whereby the rotating body 331 could independently rotate relative to the inner base 332 and the outer base 333. Furthermore, when the groove 3312 of the rotating body 331 aligns with the opening 3322 of the inner base 332 again, the ball 334 would be moved toward the groove 3312 in the radial direction of the rotating body 331, and then the ball 334 would go back to the space between the groove 3312 and the opening 3322. Besides, the ball 334 would no longer contact the rib 3331 of the outer base 333, so that the rotating body 331, the inner base 332 and the outer base 333 could go back to the relative rotatable state. Whereby, the force transmission between the first actuator 32 and the force-bearing mechanism 12 could be disconnected, whereby to automatically switch to a manual driving mode for turning the slats 13.

A control system 40 of a third embodiment of the present disclosure is illustrated in FIG. 19 to FIG. 24, which includes an electric power member 41, a first actuator 42, a centrifugal mechanism 43, a deceleration mechanism 44 and a position detection mechanism 45. The electric power member 41, which is the same as that in the previous embodiments, provides power to operate the first actuator 42. When the first actuator 42 operates, the first actuator 42 would output a first driving force. The centrifugal mechanism 43 includes a central member 431, a friction base 432, at least one movable arm 433 and at least one tension spring 434. In the current embodiment, the number of the movable arm 433 is two. However, this is not a limitation of the present disclosure. The central member 431 is coaxially positioned in the friction base 432, and is also coaxially fixed to the first driving shaft 421 of the first actuator 42, so that the central member 431 could be driven by the first driving shaft 421. The central member 431 has at least one slot 4312 provided at an axle 4311 thereof, wherein the slot 4312 faces an inner surface 4321 of the friction base 432, and is adapted to allow one end of the corresponding movable arm 433 to movably insert therein. The movable arm 433 has a friction board 4331 provided at another end thereof opposite to the slot 4312, wherein the friction board 4331 corresponds to the inner surface 4321 of the friction base 432. When the movable arm 433 is driven to move toward or away from the inner surface 4321 of the friction base 432 in the slot 4312, the friction board 4331 would abut against or be moved away from the inner surface 4321 of the friction base 432 in accordance with the movement of the movable arm 433. The end of the movable arm 433 away from the friction base 432 is connected to the tension spring 434, wherein the tension spring 434 is adapted to urge the movable arm 433 to move in a direction toward the inner surface 4321 of the friction base 432. In the current embodiment, the numbers of the movable arm 433 and the slot 4312 are both two, and each end of the tension spring 434 is fixed to one of the movable arms 433. When there is no external force applied, the compression force of the tension spring 434 would pull one end of each of the movable arm 433 to abut against a bottom of the corresponding slot 4312. As a result, each of the friction boards 4331 would not contact the inner surface 4321 of the friction base 432.

In the present embodiment, the deceleration mechanism 44 is a double planetary gear deceleration system, which includes a double planetary deceleration assembly and a worm assembly 443. The double planetary deceleration assembly is composed of two single planetary deceleration assemblies 441, 442 which are connected in series. Specifically, the double planetary deceleration assembly includes a single planetary deceleration assembly 441 the same as the single planetary deceleration assembly 341 of the planetary gear deceleration mechanism 34, and another single planetary deceleration assembly 442 connected to the single planetary deceleration assembly 441 in series. The single planetary deceleration assembly 441 includes a first ring gear 4411, a first planetary carrier 4412 and a first sun gear 4413 which coaxially fit around one another from outside to inside sequentially. The first ring gear 4411 has an inner toothed surface, and each of the planetary gears 4414 is positioned at the first planetary carrier 4412 between the first ring gear 4411 and the first sun gear 4413. The other single planetary deceleration assembly 442 includes a second ring gear 4421, a second planetary carrier 4422 and a second sun gear 4423 which are also coaxially provided. The second ring gear 4421 includes an inner toothed surface. The second planetary carrier 4422 fits in the second ring gear 4421, and two sides of the second planetary carrier 4422 are respectively a third surrounded portion 44221 and a fourth surrounded portion 44222. A plurality of second planetary gears 44223 are positioned between the third surrounded portion 44221 and the fourth surrounded portion 44222 in an axial direction. The second sun gear 4423 passes through the third surrounded portion 44221, and is positioned between the plurality of second planetary gears 44223, so that the second planetary gears 44223 are positioned between the second ring gear 4421 and the second sun gear 4423. Each of the second planetary gears 44223 meshes with the second sun gear 44423 and the inner toothed surface of the second ring gear 4421. The second sun gear 4423 is fixedly connected to the first planetary carrier 4412, whereby to be rotated by the first planetary carrier 4412. The second planetary carrier 4422 has a second protruded axle 44224 protruding from the fourth surrounded portion 44222, and the worm 4431 of the worm assembly 443 is coaxially fixed to the second protruded axle 44224, so that the worm 4431 of the worm assembly 443 could be driven by the second protruded axle 44224. The worm wheel 4432 meshes with the worm 4431. In addition, the first sun gear 4413 is fixedly connected to the friction base 432 of the centrifugal mechanism 43.

When the first sun gear 4413 is rotated by the friction base 432, each of the first planetary gears 4414 would be rotated by the first sun gear 4413 through the meshing relationship therebetween, so that each of the first planetary gears 4414 could rotate about its own axis, and could revolve along the inner toothed surface of the first ring gear 4411. Therefore, the first planetary carrier 4412 would be rotated by the rotation of the first planetary gears 4414. When the second sun gear 4423 is consequently rotated by the first planetary carrier 4412, each of the second planetary gears 44223 would be rotated by the second sun gear 4423 through the meshing relationship therebetween, so that each of the second planetary gears 44223 could rotate about its own axis, and could revolve along the inner toothed surface of the second ring gear 4421. Therefore, the second planetary carrier 4422 could be rotated by the rotation of the second planetary gears 44223. As a result, the rotation speed of the worm wheel 4432 could be reduced, for the second planetary carrier 4422 could drive the worm 4431 and the worm wheel 4432 to rotate. In the present embodiment, the first ring gear 4411 and the second ring gear 4421 could be formed integrally.

The worm wheel 4432 is coaxially fixed to the output shaft 121 of the force-bearing mechanism 12; when the worm wheel 4432 rotates, the output shaft 121 would be rotated by the worm wheel 4432. The output shaft 121 meshes with the encoder gear 351 of the position detection device 35, and both of them could be driven by each other. The operating principle of the position detection device 45 is the same as that of the optical position detection devices in the previous embodiments, wherein the output shaft 121 simultaneously rotates the encoder gear 351 and the encoder disk 352 to record the current tilt angle of the slats 13 while the slats 13 are being turned and the output shaft 121 is, therefore, being rotated. However, since the arrangement of the position detection device 45 is the same as those in the previous embodiments, related details would not be described again herein.

When the first actuator 42 outputs the first driving force through the first driving shaft 421, the central member 431 would be rotated by the first driving force relative to the friction base 432. At the moment, the movable arm 433 would be driven by the central member 431 to rotate relative to the friction base 432 as well. When the rotation speed of the first driving force reaches a predetermined speed, and generates a centrifugal force to overcome the compression force of the tension spring 434, the movable arms 433 would be driven by the centrifugal force to move toward the inner surface 4321 of the friction base 432 along the slot 4312. As a result, the friction board 4331 at one end of each of the movable arms 433 would abut against the inner surface 4321 of the frictional base 432 to rotate the friction base 432 through a friction force, so that the friction base 432 and the central member 431 could be rotated synchronously by the first driving force in the same direction. Furthermore, since the friction base 432 could drive the planetary gear deceleration mechanism 44 to rotate, the rotation speed of the first driving force would be decreased after passing through the deceleration mechanism 44, whereby the output shaft 121 of the force-bearing mechanism 12 could be driven with a proper strength and proper rotation speed to turn the slats 13.

When the first actuator 42 stops outputting the first driving force, the central member 431 and the movable arms 433 are no longer driven by any external force. At the same time, the compression force created by the tension spring 434 would pull the movable arms 433 toward the central member 431, so that the friction boards 4331 of each of the movable arms 433 would not contact the inner surface 4321 of the friction base 432. After that, the friction base 432 could be independently rotated relative to the central member 431, whereby the force transmission between the first actuator 42 and the force-bearing mechanism 12 could be disconnected, whereby to automatically switch to the manual driving mode for turning the slats 13.

Figure 25:
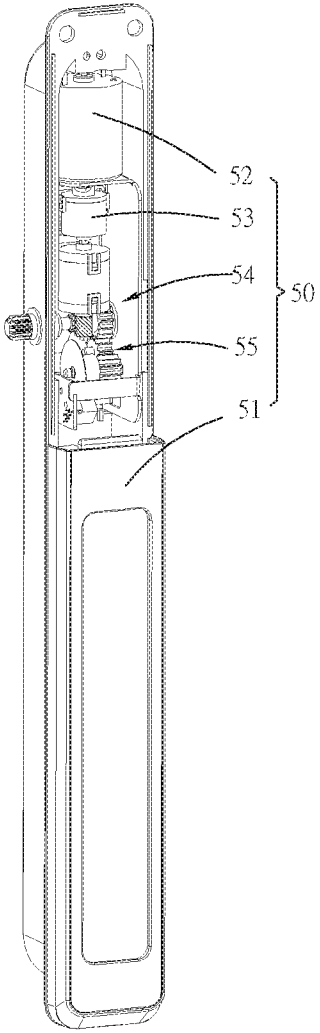
FIG. 25 is a perspective view, showing the whole control system of a fourth embodiment.
Figure 29:
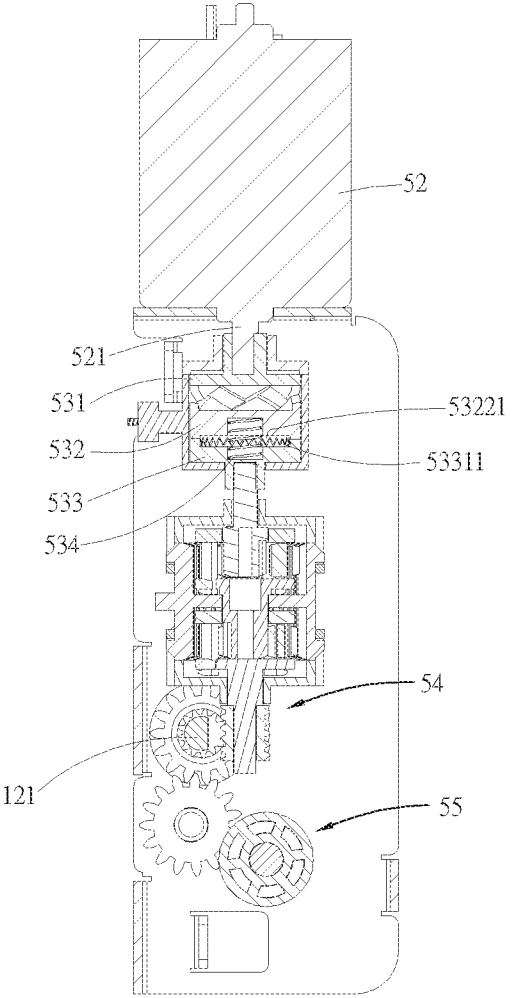
FIG. 29 is a sectional view, showing the condition when the control system of the fourth embodiment is linked to the force-bearing mechanism.

A control system of a fourth embodiment of the present disclosure is illustrated in FIG. 25 and FIG. 29, which includes an electric power member 51, a first actuator 52, a pushing mechanism 53, a deceleration mechanism 54 and a position detection mechanism 55. The arrangements and structures of the electric power member 51, the first actuator 52, the deceleration mechanism 54 and the position detection device 55 are respectively the same as their equivalents in any previous embodiments, and therefore the related details would not be described again herein.

In the present embodiment, the pushing mechanism 53 includes a first clutch wheel 531, a movable wheel 532, a second clutch wheel 533 and a restoring spring 534. The first clutch wheel 531, the movable wheel 532 and the second clutch wheel 533 are sequentially positioned in the axial direction of the pushing mechanism 53. The first clutch wheel 531 has a first end surface 5311 facing the movable wheel 532, and a toothed protrusion protruding from the first end surface 5311 toward the movable wheel 532. The toothed protrusion has a plurality of first peaks 53111 and a plurality of first valleys 53112; a first inclined surface 53113 is formed between each adjacent first peak 53111 and first valley 53112. The movable wheel 532 has a second end surface 5321 and a third end surface 5322. The second end surface 5321 corresponds to the first end surface 5311 of the first clutch wheel 531, and the second end surface 5321 has a plurality of second peaks 53211 and a plurality of second valleys 53212 formed thereon. The second peaks 53211 correspond to the first valleys 53112, while the second valleys 53212 correspond to the first peaks 53111. A second inclined surface 53213 is formed between each adjacent second peak 53211 and second valley 53212, wherein the second inclined surfaces 53213 face the first inclined surfaces 53113. The third end surface 5322 of the movable wheel 532 is a toothed engaging portion 53221. The second clutch wheel 533 has a fourth end surface 5331 corresponding to the third end surface 5322 of the movable wheel 532, and the fourth end surface 5331 has a toothed meshing portion 53311 corresponding to the toothed engaging surface 53221. The restoring spring 534 is positioned between the movable wheel 532 and the second clutch wheel 533. In the pushing mechanism 53, the first clutch wheel 531 is fixedly connected to the first output shaft 521 of the first actuator 52, so that the first clutch wheel 531 could be driven by the output shaft 521 to rotate. The second clutch wheel 533 is fixedly connected to the first sun gear 541 of the deceleration mechanism 54. When the second clutch wheel 533 is rotated, the strength and the rotation speed of the first driving force transmitted to the output shaft 121 of the force-bearing mechanism 12 could be changed through the deceleration mechanism 54.

Figure 26:
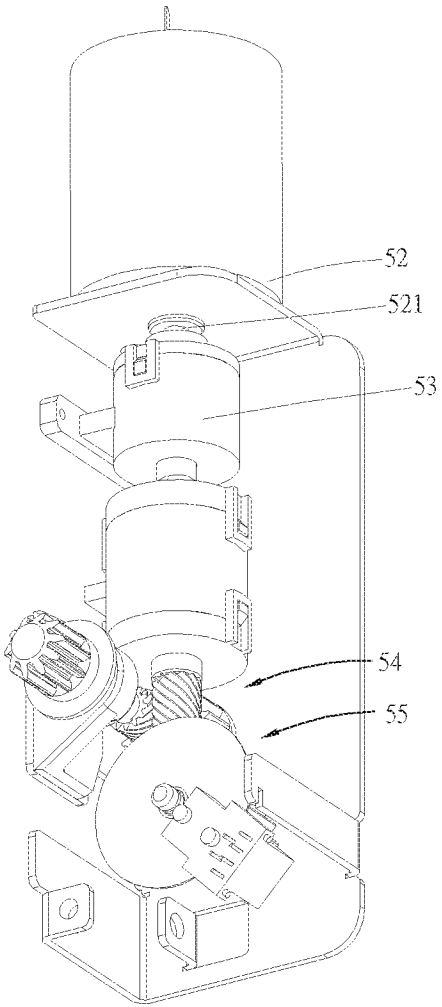
FIG. 26 is a perspective view, showing part of the control system of the fourth embodiment.
Figure 27:
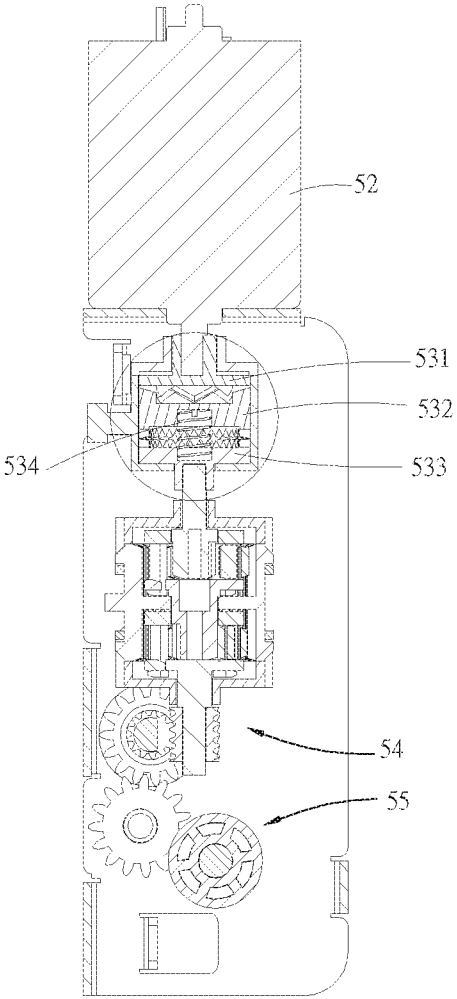
FIG. 27 is a sectional view, showing the condition when the control system of the fourth embodiment is not linked to the force-bearing mechanism.
Figure 28:
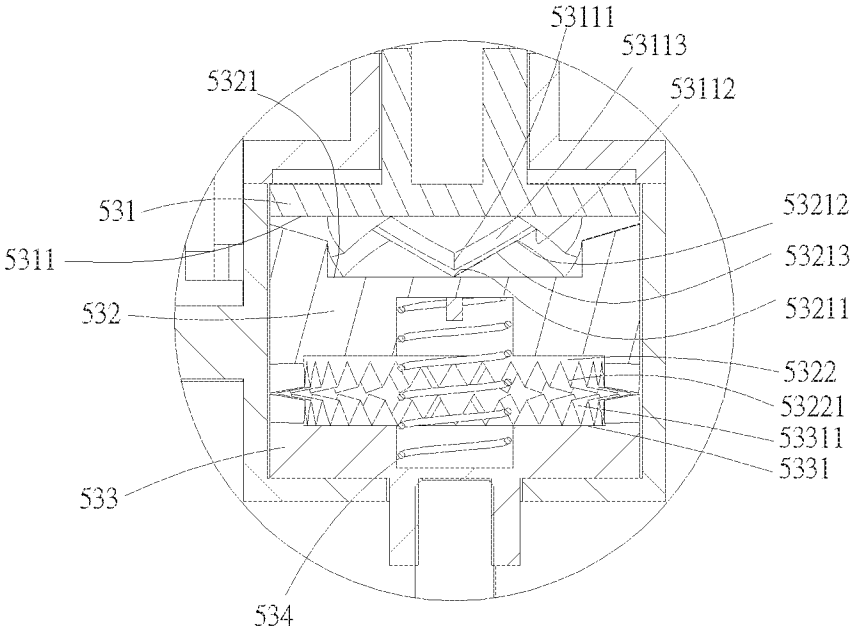
FIG. 28 is a partial enlarged view of FIG. 27.

As shown in FIG. 26 to FIG. 28, when the first clutch wheel 531 of the pushing mechanism 53 is not driven by any external force, the first peaks 53111 and the first valleys 53112 of the first clutch wheel 531 are respectively separated from the corresponding second valleys 53211 and the second peaks 53212 of the movable wheel 532 by a distance, i.e., a gap is formed therebetween. The movable wheel 532 and the second clutch wheel 533 are pushed outward by the restoring spring 534, so that a gap is formed between the toothed engaging portion 53221 of the movable wheel 532 and the toothed meshing portion 53311, whereby the toothed engaging portion 53221 and the toothed meshing portion 53311 do not contact each other. At the moment, the second clutch wheel 533 could rotate freely relative to the first clutch wheel 531, so that the slats 13 could be turned manually, and the position detection device 55 could corresponds to the current tilt angle of the slats 13 synchronously.

As shown in FIG. 29, when the first driving shaft 521 of the first actuator 52 outputs the first driving force in a first rotation direction, the first driving force would drive the first clutch wheel 531 of the pushing mechanism 53 to rotate freely relative to the movable wheel 532 in the first rotation direction, which could drive the first inclined surface 53113 to move close to the second inclined surface 53213 until both of them abut against each other. After that, by continuously rotating the first clutch wheel 531, the second inclined surface 53213 would be forced to slip along the first inclined surface 53113 as being continuously pushed, and the movable wheel 532 would be also forced to move in an axial direction toward the second clutch wheel 533 at the same time, so that the toothed engaging portion 53221 of the movable wheel 532 and the toothed meshing portion 53311 of the second clutch wheel 533 would be engaged (i.e., meshed) with each other. At the same time, all of the first clutch wheel 531, the movable wheel 532 and the second clutch wheel 533 would be rotated in the first rotation direction by the first driving force, and then the first driving force would be transmitted to the deceleration mechanism 54 through the second clutch 533. Whereby, the strength and the rotation speed of the first driving force transmitted to the output shaft 121 of the force-bearing mechanism 12 could be changed. When the movable wheel 532 is moved toward the second clutch wheel 533, the restoring spring 534 fixed between the movable wheel 532 and the second clutch wheel 533 would be compressed to store a restoring elastic force.

Before the control system 50 completely stops operating, the first actuator 52 would output the second rotating force in the second rotation direction through the first output shaft 521, wherein the second rotation direction is opposite to the first rotation direction. The first clutch wheel 531 would be driven by the second rotation force, so that the first inclined surface 53113 would be rotated to leave the second inclined surface 53213 till both of them no longer contact each other. After that, the movable wheel 532 would be disconnected from the first clutch wheel 531; at the same time, the movable wheel 532 would be pushed by the restoring elastic force of the restoring spring 534 to move in the axial direction toward the first clutch wheel 531 till the toothed engaging portion 53221 of the movable wheel 532 is disengaged from the toothed meshing portion 53311 of the second clutch wheel 533. Therefore, the second clutch wheel 533 would go back to a position where it does not hinder the second clutch wheel 533 from rotating freely relative to the first clutch wheel 531, so that the slats 13 could be rotated manually.

As shown in FIG. 30 to FIG. 33, it is worth mentioning that, the arrangements of the force-bearing mechanism and the slats in the current embodiment are different from those in the previous embodiments. In the current embodiment, the slats includes a driving slat 131 and a plurality of driven slats 132 respectively positioned between the top beam 111 and the bottom beam 112 parallel to each other. Two ends of each of the driven slats 132 are respectively connected to the two posts 133 in a manner that each of the driven slats is turnable. As for the driving slat 131, though the driving slat 131 is also turnable, only one end thereof is connected to one of the posts 133, and another end thereof is connected to the force-bearing mechanism 12 to be driven by each other. The force-bearing mechanism 12 is a driving mechanism with a link, and includes the aforementioned output shaft 121 and the link 125, wherein the output shaft 121, as mentioned above, could be driven by the control system 50. The output shaft 121 is fixedly connected to the driving slat 131, and the link 125 is connected to one corner of the driving slat 131 and one corner of each the driven slats 132. More specifically, the link 125 has a plurality of connecting portions 1251, wherein one of the connecting portions 1251 is connected to the corner of the driving slat 131, while each of the rest of the connecting portions 1251 is respectively connected to the corner of one of the driven slats 132. When the output shaft 121 drives the driving slat 131 to turn, the link 125 would be driven by the driving slat 131 to correspondingly turn the driven slats 132 in the same direction as the driving slat 131, whereby to adjust a light blocking range of the slats 131, 132. However, the connecting portions 1251 of the link 125 is not limited to be connected to the corners of the slats 131, 132, and could be also connected to one side edge of each of the slats 131, 132 instead as well.

When the output shaft 121 is driven by the control system, the output shaft 121 would drive the driving slat 131 to turn in the same rotation direction as the output shaft 121. At the same time, the link 125 would be moved by the turning of the driving slat 131, and the movement of the link 125 would drive the driven slats 132 to turn synchronously with the driving slat 131, whereby the tilt angle of the driving slat 131 and the driven slats 132 could be adjusted by electric driving methods.

When the control system stops operating, the output shaft 121 would be no longer driven by the control system, and at the same time, the link 125 could be driven manually to turn the driving slat 131 and the driven slats 132 altogether, which would also drive the output shaft 121 to rotate.

Figure 30:
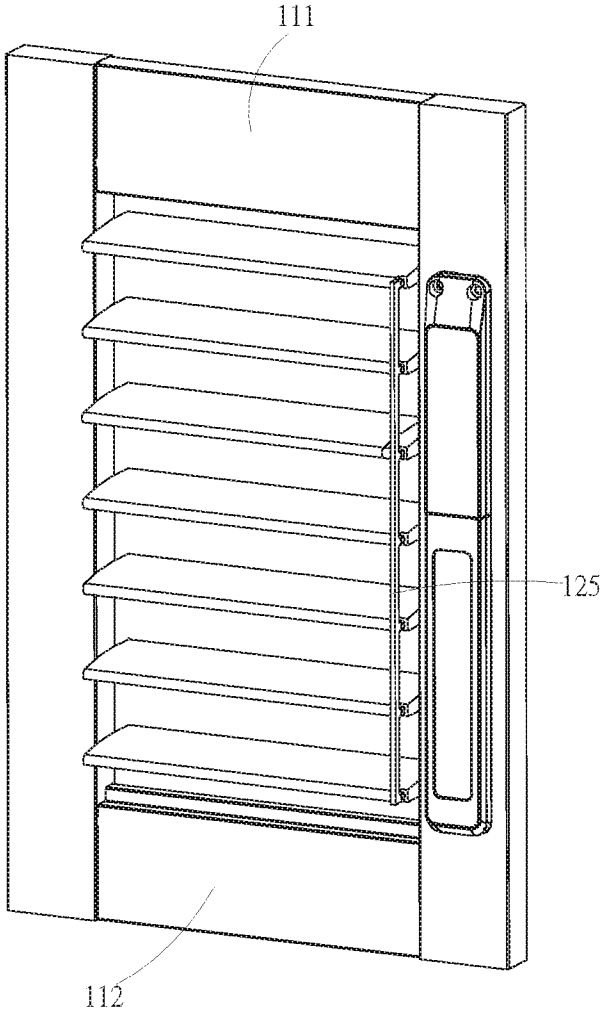
FIG. 30 is a perspective view, showing the force-bearing mechanism of the shutter applied with the control system of the fourth embodiment.
Figure 31:
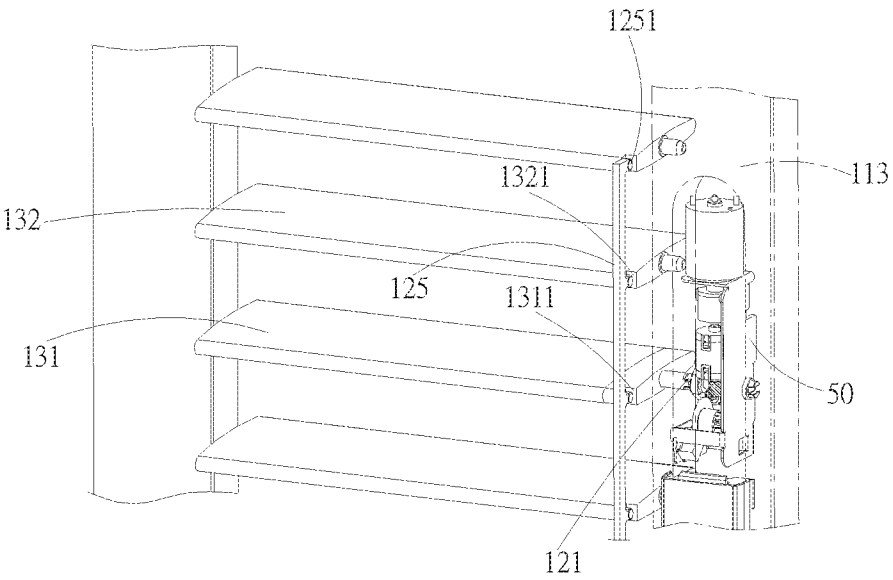
FIG. 31 is a perspective view, showing the force-bearing mechanism of the shutter applied with the control system of the fourth embodiment and the control system of the fourth embodiment.

As shown in FIG. 30 and FIG. 31, in the current embodiment, the driving slat 131 and each of the driven slats 132 could respectively have a notch 1311, 1321 formed at one corner thereof. Each of the connecting portions 1251 of the link 125 is pivotally connected to a side wall of each of the notches 1311, 1321. When the driving slat 131 and the driven salts 132 are turned to be closed, the link 125 would follow the movement of the corners of the slats 131, 132 to be received in the notches 1311, 1321, which could make the shutter look tidy.

Figure 32:
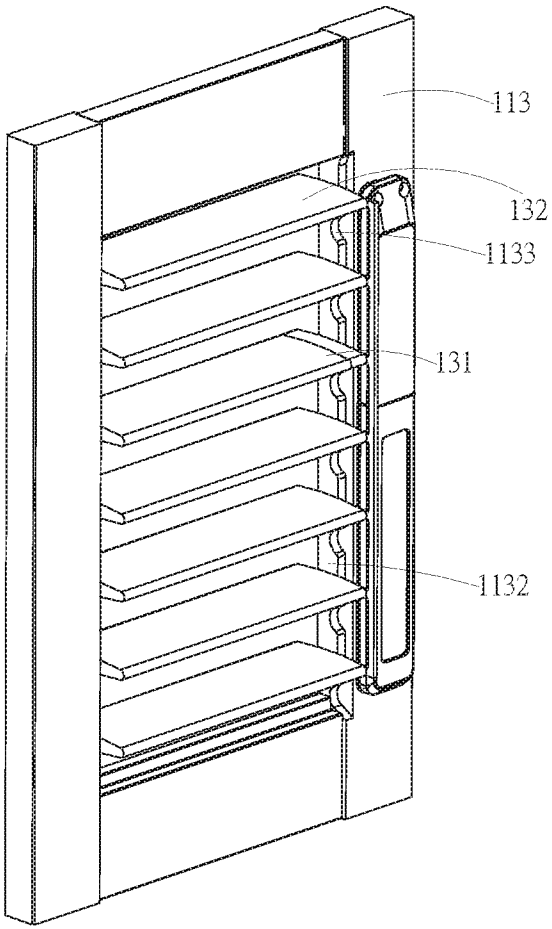
FIG. 32 is a perspective view, showing another force-bearing mechanism of the shutter applied with the control system of the fourth embodiment and the control system of the fourth embodiment.
Figure 33:
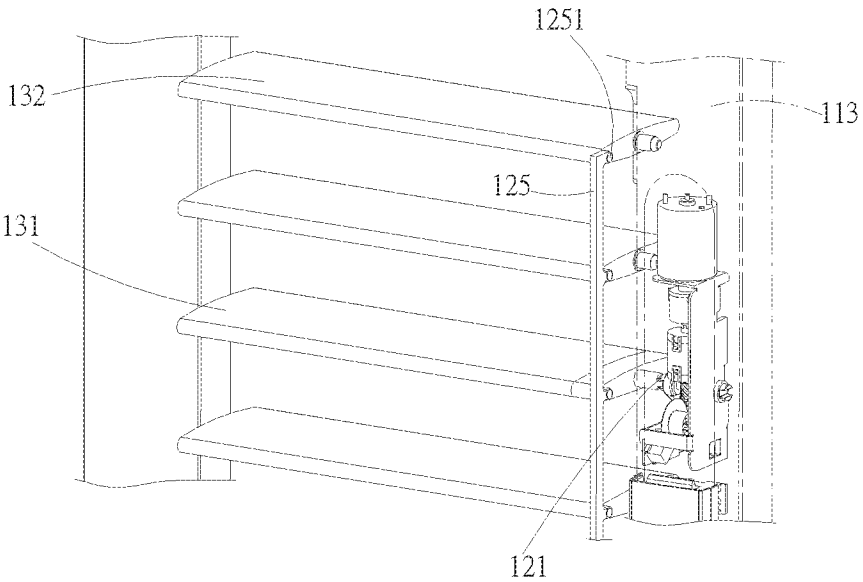
FIG. 33 is a perspective view, showing another force-bearing mechanism of the shutter applied with the control system of the fourth embodiment and the control system of the fourth embodiment.
Figure 34:
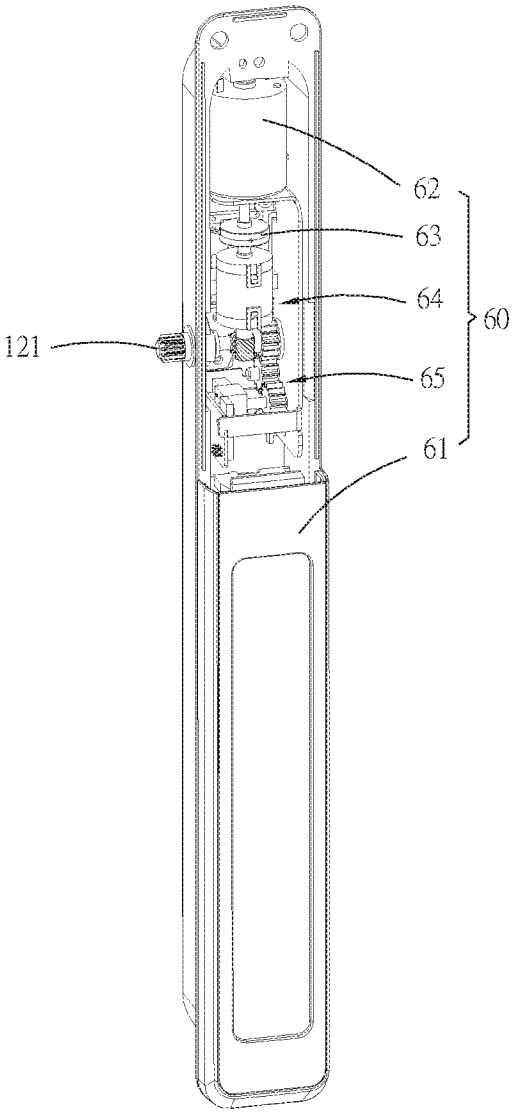
FIG. 34 is a perspective view, showing the whole control system of a fifth embodiment.
Figure 35:
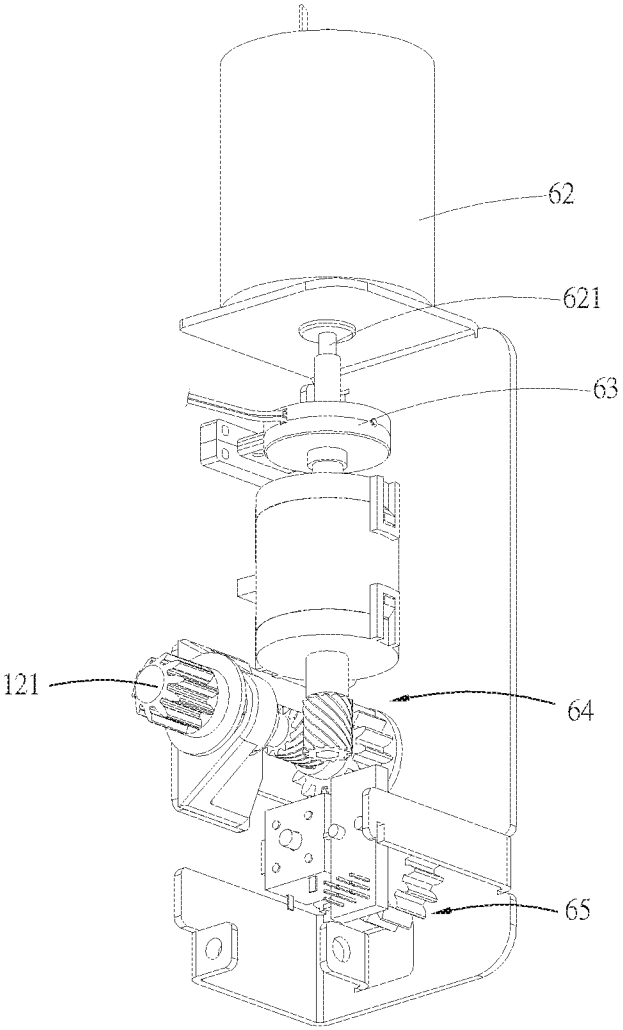
FIG. 35 is a perspective view, showing part of the control system of the fifth embodiment.
Figure 36:
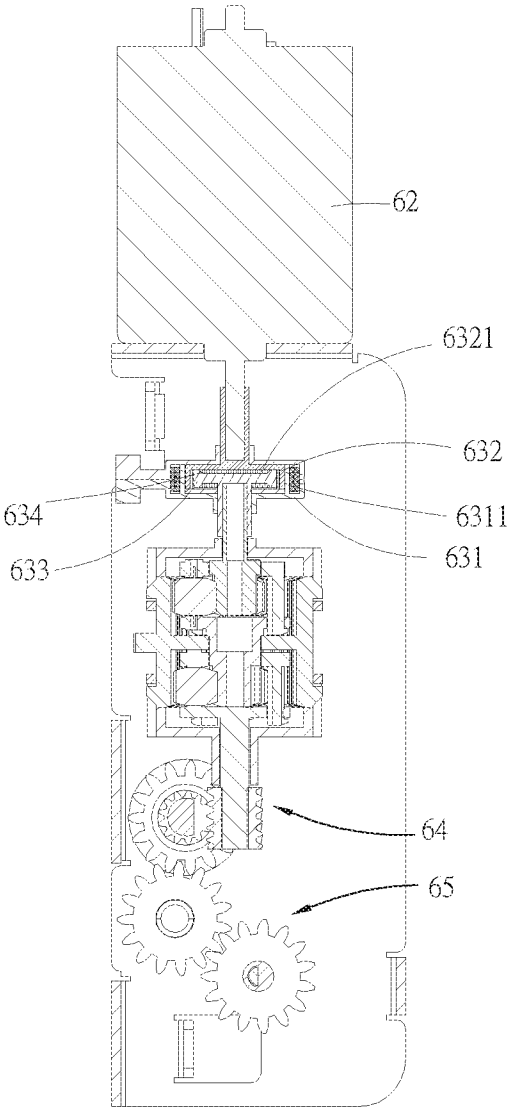
FIG. 36 is a partial sectional view, showing the control system of the fifth embodiment.
Figure 37:
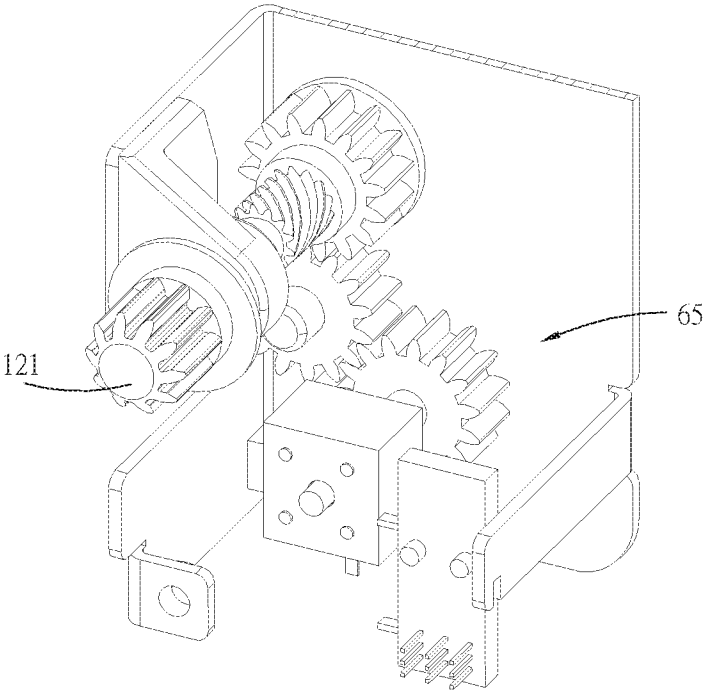
FIG. 37 is a perspective view, showing the position detection device of the control system of the fifth embodiment.
Figure 38:
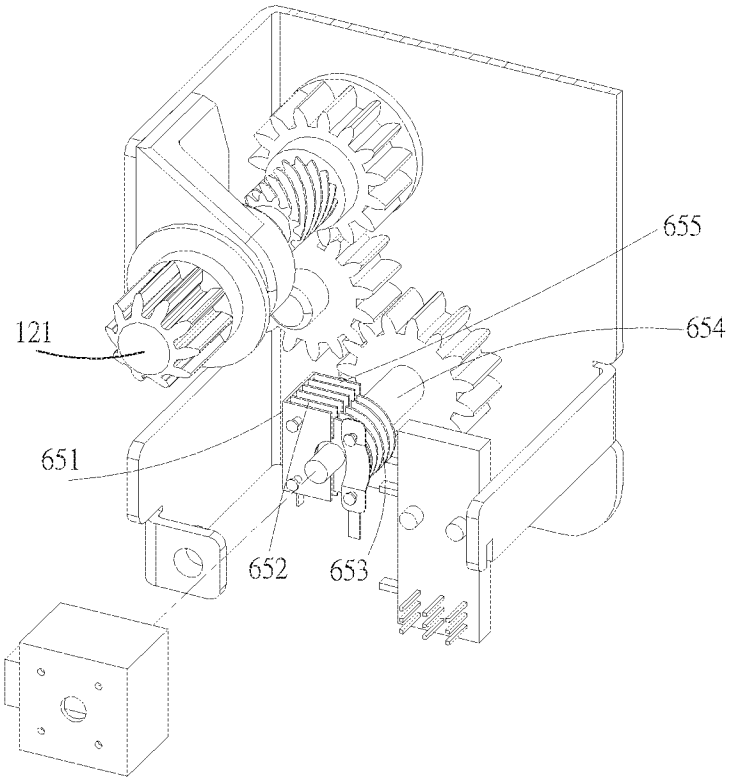
FIG. 38 is a perspective view, showing the internal arrangements of the position detection device of the control system of the fifth embodiment.

Different from the aforementioned arrangements of the link and the slats, the corners of the driving slat 131 and the driven slats 132 could also have no notch, as shown in FIG. 32 and FIG. 33. In this case, the link 125 is directly pivotally connected to the slats 131, 132 through the connecting portions 1251. Furthermore, an inner surface 1132 of one of the posts 113, which is near the connecting portions 1251 of the link 125, has a plurality of troughs 1133 provided thereon. The troughs 1133 are positioned in the longitudinal direction of said post 1133, and correspond to the connecting portions 1251. Each of the troughs 1133 is formed between two adjacent ones of the slats 131, 132. When the driving slat 131 and the driven slats 132 are turned to be closed, the link 125 would follow the movement of the corners of the slats 131, 132 to be accommodated in the troughs 1133, whereby to conceal the link 125.

A control system 60 of a fifth embodiment of the present disclosure is illustrated in FIG. 34 to FIG. 40, which includes an electric power member 61, a first actuator 62, an electromagnetic mechanism 63, a deceleration mechanism 64 and a position detection device 65. The arrangements of the first actuator 62 and the deceleration mechanism 64 are the same as the previous embodiments, so the first actuator 62 and the deceleration mechanism 64 in the current embodiment will not be described in details again herein. The electric power member 61 is adapted to provide power to operate the first actuator 62 and the electromagnetic mechanism 63. The first actuator 62 has a first driving shaft 621 which is adapted to output the first driving force. In the current embodiment, the electromagnetic mechanism 63 includes a yoke 631, a rotor base 632, a rotor 633 and magnetic powders 634. The yoke 631 is hollow and circular, and is wound around by conductive coils 6311. The coils 6311 are connected to the electric power member 61, wherein the electric power provided by the electric power member 61 would induce the coils 6311 and the yoke 631 to create an induced magnetic field through electromagnetic induction. The rotor base 632 passes through the yoke 631, and is fixedly connected to the first driving shaft 621 of the first actuator 62, so that the rotor base 632 could be driven to rotate by the first actuator 62. The rotor base 632 has a rotor accommodating groove 6321 slightly larger than the rotor 633, wherein and the rotor 633 is accommodated in the rotor accommodating groove 6321. The magnetic powders 634 are randomly distributed between the rotor 633 and an inner wall of the rotor accommodating groove 6321. The rotor 633 is fixedly connected to the deceleration mechanism 64, so that the strength and the rotation speed of the first driving force could be changed through the deceleration mechanism 64 to a degree suitable for driving the output shaft 121 of the force-bearing mechanism 12 to rotate. Furthermore, the position detection device 65 would be also driven along with the output shaft 121 in correspondence with the current tilt angle of the slats which are driven by the output shaft 121.

As shown in FIG. 37 to FIG. 40, in the current embodiment, the position detection device 65 is a position detection device with variable capacitances, and includes a fixed board 651, a plurality of metal stators 652, a plurality of metal movers 653 and an adjusting rod 654. The metal stators 652 are fixed on the fixed board 651 in an upright position, and are parallel to each other. Each of the metal movers 653 is positioned in a corresponding gap which is formed between two adjacent metal stators 652. The metal movers 653 are respectively fixedly connected to the adjusting rod 654, and could be driven the adjusting rod 654 to rotate about the adjusting rod 654. The adjusting rod 654 could be driven by the output shaft 121 of the force-bearing mechanism 12, so that the adjusting rod 654 could drive the metal movers 653 to gradually enter the gaps 655 or to gradually leave the gap 655 when the output shaft 121 rotates, whereby an area of each of the metal movers 653 located in the corresponding gap 655 could be adjusted.

Figure 39:
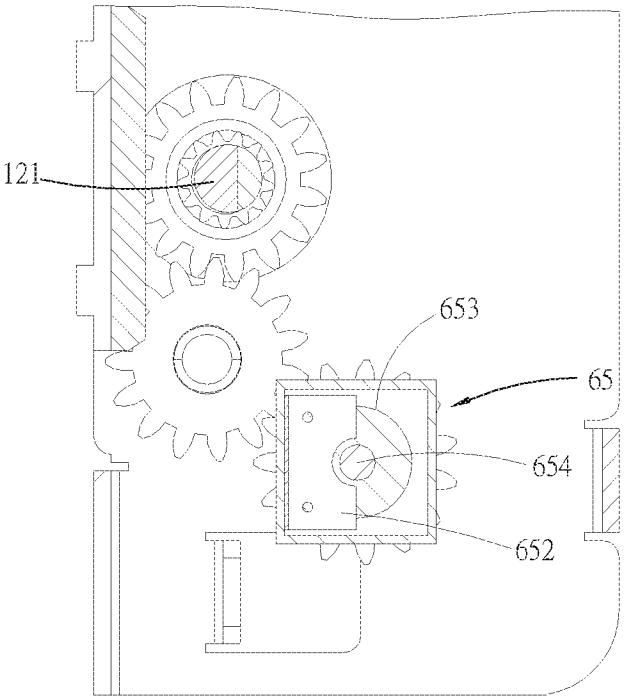
FIG. 39 is a first sectional view, showing the position detection device of the control system of the fifth embodiment in use.
Figure 40:
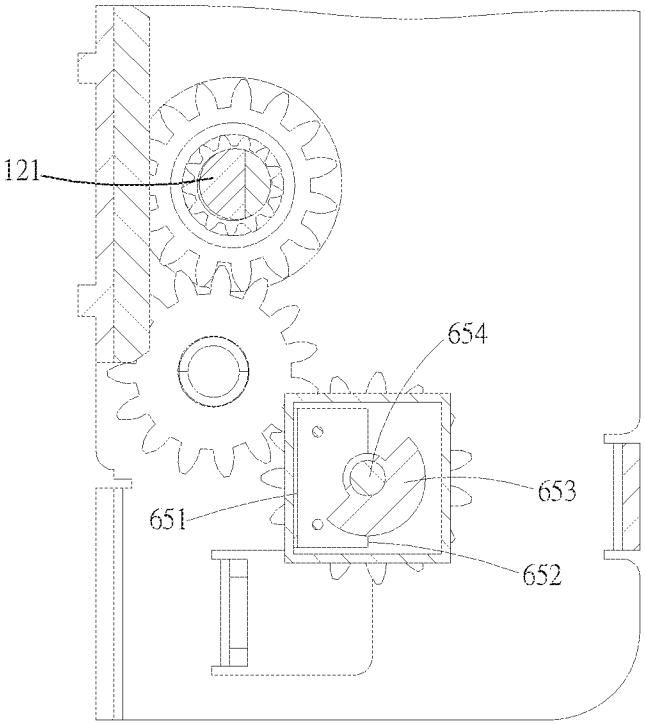
FIG. 40 is a second sectional view, showing the position detection device of the control system of the fifth embodiment in operation.
Figure 41:
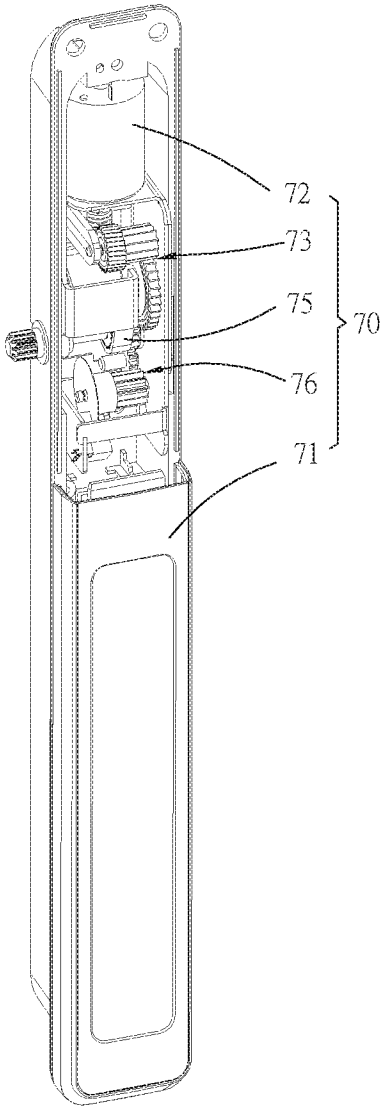
FIG. 41 is a perspective view, showing the whole control system of a sixth embodiment.
Figure 42:
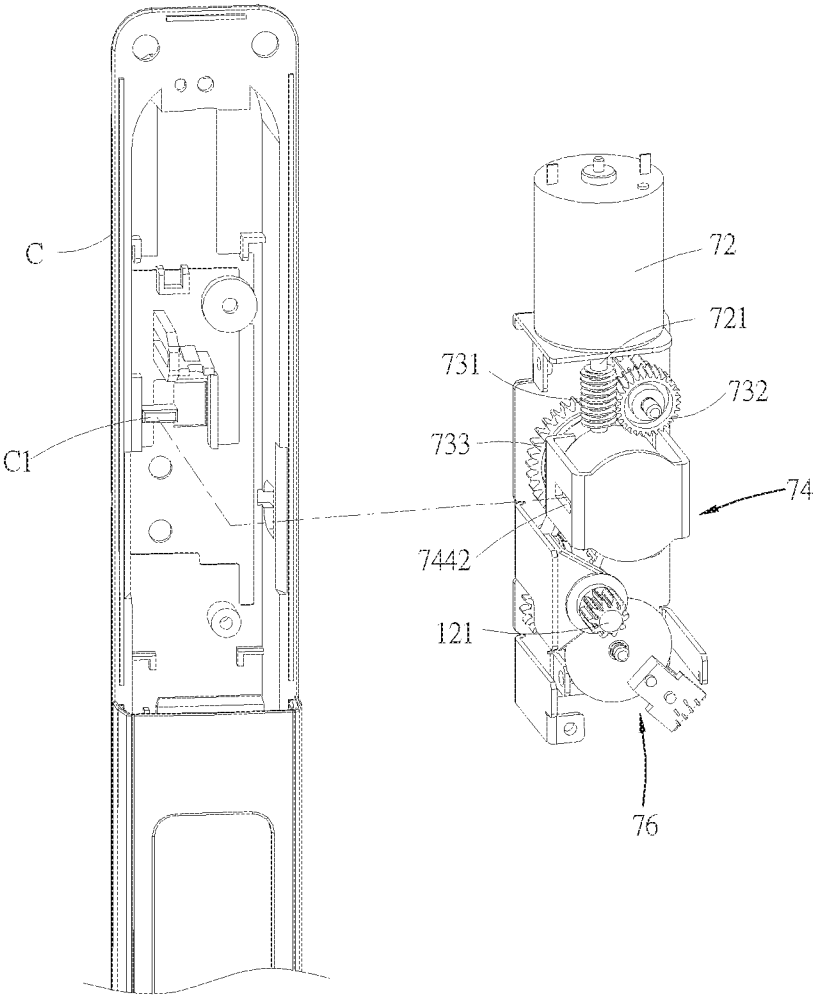
FIG. 42 is a partial exploded view, showing the control system of the sixth embodiment.
Figure 43:
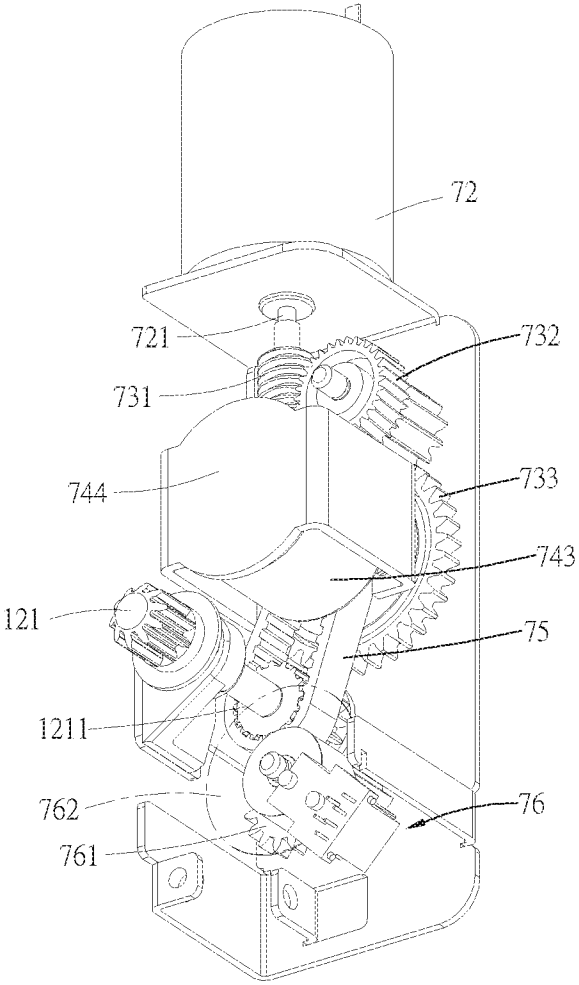
FIG. 43 is a perspective view, showing part of the control system of the sixth embodiment.
Figure 44:
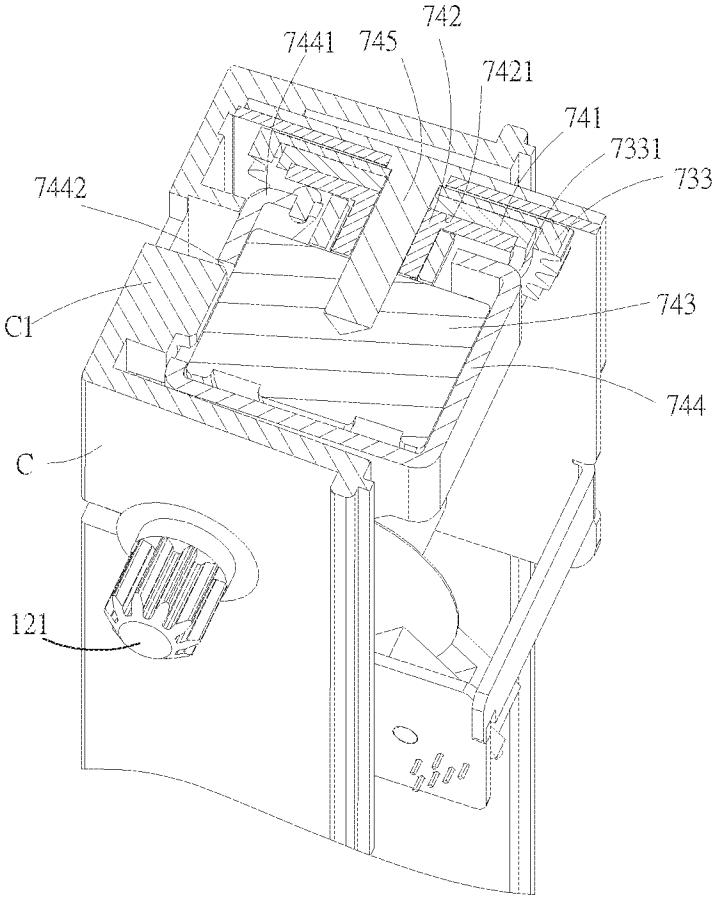
FIG. 44 is a partial sectional view, showing the control system of the sixth embodiment.
Figure 45:
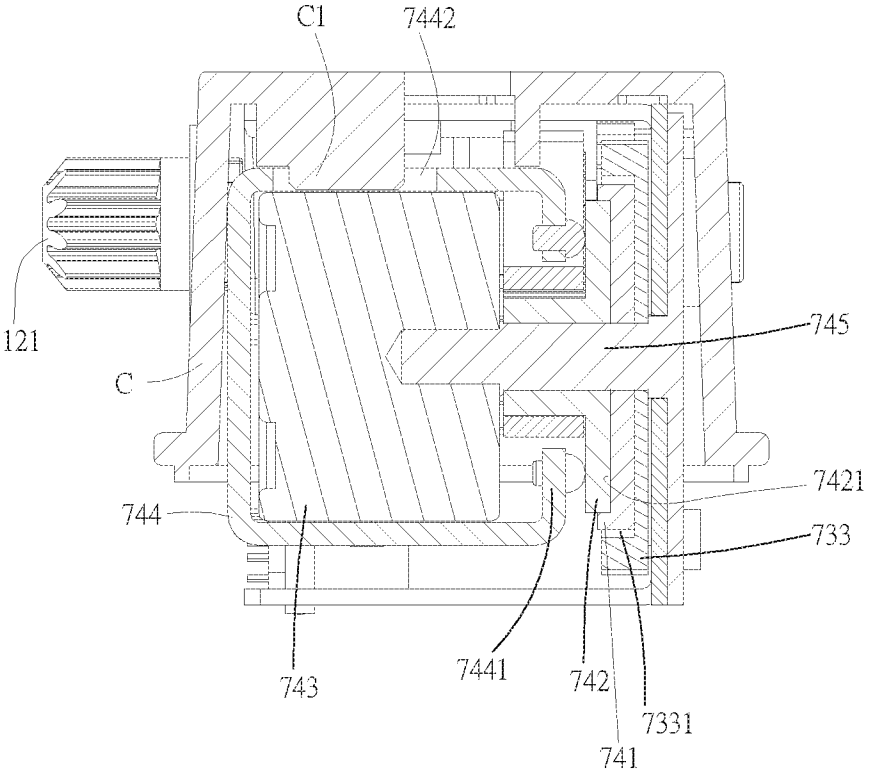
FIG. 45 is a sectional view, showing the condition when the control system of the sixth embodiment is not linked to the force-bearing mechanism.
Figure 46:
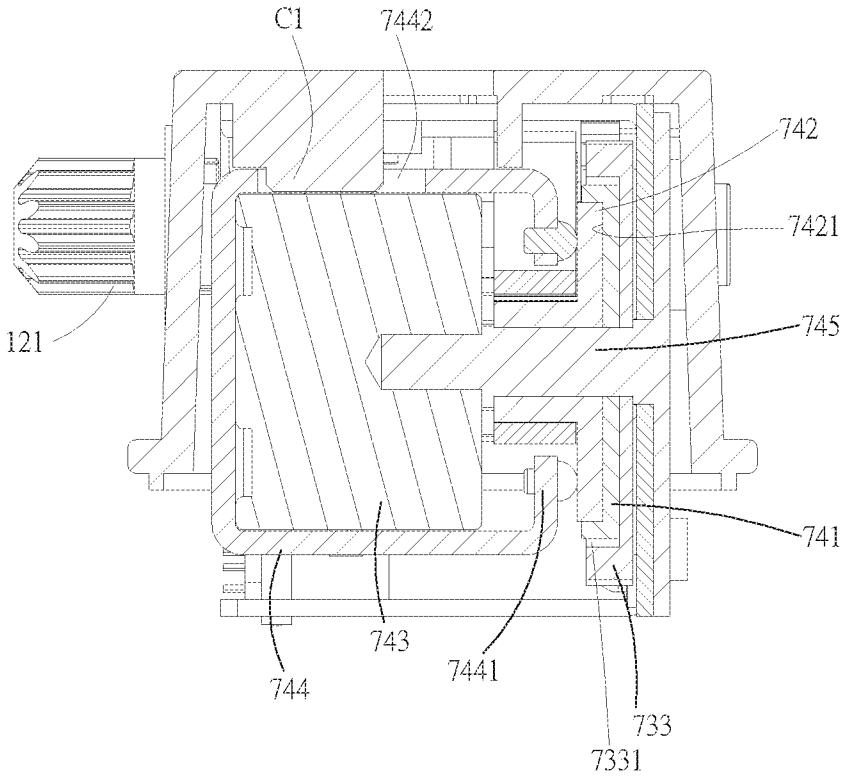
FIG. 46 is a sectional view, showing the condition when the control system of the sixth embodiment is linked to the force-bearing mechanism.
Figure 47:
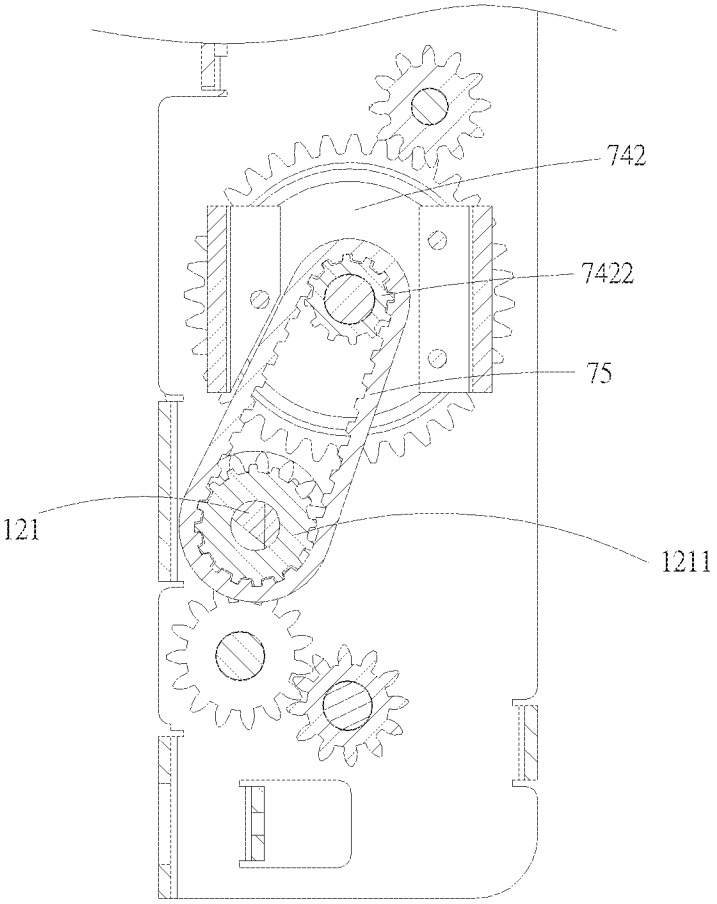
FIG. 47 is a front-side sectional view, showing the control system of the sixth embodiment.

When the metal movers 653 are rotated to a position completely out of the gaps 655, as shown in FIG. 39, the capacitance between the metal stators 652 and the gaps 655 would be minimum; when the metal movers 653 are rotated to gradually enter the gaps 655, as shown in FIG. 40, the capacitance between the metal stators 652 and the gaps 655 would be gradually increased along with the increase of an overlapped area between the metal movers 653 and the metal stators 652. The capacitance would reach a maximum value when the metal movers 653 are completely located inside the gaps 655.

When the electric power member 61 provides electric power to the coils 6311 wound around the yoke 631, the coils 6311 and the yoke 631 would create the induced magnetic field through electromagnetic induction, whereby the magnetic lines of force of the induced magnetic field would drive the magnetic powders 634 to align in order between an inner wall of the rotor accommodating groove 6321 and the rotor 633, forming magnetic powder chains, so that the rotor base 632 driven by the first actuator 62 could transmit the first driving force to the rotor 633 through the magnetic powder chains, whereby to rotate the rotor 633. Furthermore, the output shaft 121 of the force-bearing mechanism 12 could be rotated by the deceleration mechanism 64 through the rotation of the rotor 633. In this way, eventually, the tilt angle of the slats driven by the output shaft 121 could be adjusted by electric driving methods.

Since the adjusting rod 654 of the position detection device 65 could be driven by the output shaft 121, when the output shaft 121 rotates the slats, the metal movers 653 of the position detection device 65 would be rotated to change the overlapped area between the metal movers 653 and the metal stators 652, whereby to create different values of capacitance to represent current tilt angles of the slats.

When the electric power member 61 stops providing electric power to the first actuator 62 and the coils 6311, the induced magnetic field created by the yoke 631 and the coils 6311 would disappear, and the magnetic powders return to a randomly distributed state, so that the rotor 633 could freely rotate relative to the rotor base 632, i.e., the force transmission route between the first actuator 62 and the force-bearing mechanism 12 would be disconnected. In such state, the output shaft 121 of the force-bearing mechanism 12 could be freely rotated when the slats are turned manually; at the same time, the metal movers 653 of the position detection device 65 would be rotated to change the overlapped area between the metal movers 653 and the metal stators 652 in correspondence with the change of the tilt angle of the slats made by hand. Furthermore, when next time the slats are about to be turned in the electric driving mode, the control system could determine the tilt angle of the slats according to the capacitance which corresponds to the current angle of the slats.

A control system 70 of a sixth embodiment of the present disclosure is illustrated in FIG. 41 to FIG. 47, which includes an electric power member 71, a first actuator 72, a deceleration mechanism 73, an electromagnetic mechanism 74, a transmission member 75 and a position detection device 76. The electric power member 71 is adapted to provide power to operate the first actuator 72 and the electromagnetic mechanism 74. The first actuator 72 has a first driving shaft 721 which is adapted to output the first driving force. The first driving shaft 721 is connected to the deceleration mechanism 73, wherein the first driving shaft 721 and the deceleration mechanism 73 are adapted to be driven together. Whereby, the strength and the rotation speed of the first driving force could be changed after passing through the deceleration mechanism 73. The deceleration mechanism 73 is similar to the gear deceleration mechanism in the first embodiment, and includes a worm 731, a worm gear 732 and a connecting gear 733. Similar to the first embodiment, the worm 731 is coaxially fixed to the first output shaft 721 of the first actuator 72, and is adapted to be driven by the first output shaft 721. The worm 731 and the worm gear 732 mesh with each other, and the worm gear 732 also meshes with the connecting gear 733. The strength and the rotation speed of the first driving force outputted from the first output shaft 721 of the first actuator 72 could be changed through the deceleration mechanism 73. In addition, the connecting gear 733 has an accommodating base 7331 recessed into a surface thereof in an axial direction.

In the present embodiment, the operating mechanism of the electromagnetic mechanism 74 is different from that in each of the previous embodiments. The electromagnetic mechanism 74 includes a locking wheel 742, an elastic silicone layer 741, a magnetic attractor 743, which is an electromagnet, and an iron member 744. The connecting gear 733 of the deceleration mechanism 73, the silicone layer 741, the locking wheel 742 and the magnetic attractor 743 are coaxially positioned on an axial shaft 745 in sequence, and the locking wheel 741 is also accommodated in the accommodating base 7331 of the connecting gear 733. The silicone layer 741 is sandwiched between the locking wheel 742 and the accommodating base 7331, and has an original thickness D1. Two opposite surfaces of the silicone layer 741 respectively gently touch an inner surface 7421 of the locking wheel 742 and the bottom surface of the accommodating base 7331, wherein the silicone layer 741 could rotate relative to the locking wheel 742 and the accommodating base 7331. Furthermore, the locking wheel 742 and the silicone layer 741 could move relative to the connecting gear 733 along the axial shaft 745. The iron member 744 is a frame, which is positioned in an axial direction of the locking wheel 742. The magnetic attractor 743 is accommodated within the iron member 744. The iron member 744 has a pushing arm 7441 corresponding to the locking wheel 742. The iron member 744 could be driven to move toward or away from the locking wheel 742 relative to the magnetic attractor 743, and the pushing arm 7441 could be moved in the axial direction along with the movement of the iron member 744 to abut against the locking wheel 742. Besides, the iron member 744 further has a guiding channel 7442, and the shell C has a guiding block C1 extending into the guiding channel 7442, whereby the movement of the iron member 744 could be guided and limited by the guiding block C1.

The transmission member 75 meshes with the locking wheel 742 and the output shaft 121 of the force-bearing mechanism 12, in order to rotate the output shaft 121 by transmitting a driving force from the locking wheel 742 to the output shaft 121. In the current embodiment, the transmission member 75 is a toothed belt; the locking wheel 742 has an outer toothed surface 7422; the output shaft 121 of the force-bearing mechanism 12 further has an output gear 1211 coaxially fixed thereon. The transmission member 75 meshes with the outer toothed surface 7422 of the locking wheel 742 and the output gear 1211, whereby to transmit the driving force to the output gear 1211 from the locking wheel 742. In this way, the output shaft 121 could be driven to rotate.

Furthermore, similar to the position detection device in the first embodiment, when the output shaft 121 of the force-bearing mechanism 12 rotates, the output shaft 121 would drive the encoder gear 761 and the encoder disk 762 of the position detection device 76 to operate correspondingly. Therefore, when the tilt angle of the slats is changed, the positions of the code holes on the disk body of the encoder disk 762 would be synchronously changed in correspondence with the current position of the slats. Of course, the position detection device with variable capacitances mentioned in the previous embodiment could also be used in the present embodiment, which could provide the same function to detect the position of the slats. Whereby, the control system could determine the tilt angle of the slats accordingly. However, the details of the position detection device with variable capacitances would not be described again herein.

When the first actuator 72 provides the first driving force through the first driving shaft 721, the magnetic attractor 743 would generate a magnetic field due to the electric power from the electric power member 71, so that the iron member 744 would be attracted by the magnetic force of the magnetic field to move toward the locking wheel 742. At the moment, the pushing arm 7441 of the iron member 744 would push the locking wheel 742 to move toward the connecting gear 733, whereby the locking wheel 742 would abut against the silicone layer 741 till the silicone layer 741, the inner surface 7421 of the locking wheel 742 and the bottom surface of the accommodating base 7331 are tightly compressed together. At the same time, the silicone layer would be compressed to have a compressed thickness D2 which is less than the original thickness D1. After that, the silicone layer 741 would create sufficient friction on the locking wheel 742 and the accommodating base 7331, so that the connecting gear 733 could drive the silicone layer 741 and the locking wheel 742 to rotate synchronously. With such design, after the strength and the rotation speed of the first rotating force is changed by the deceleration mechanism 73, the first rotating force could drive the output shaft 121 of the force-bearing mechanism 12 to rotate through the electromagnetic mechanism 74 and the transmission member 75.

When the electric power member 71 stops providing the electric power to the magnetic attractor 743, the magnetic force driving the iron member 744 would disappear, so that the locking wheel 742 would no longer tightly abutting against the silicone layer 741. At the moment, the silicone layer 741 returns to the original thickness D1 through its inherent elasticity, and the elastic force of the silicone layer 741 would be applied to the bottom surface of the accommodating base 7331 and the inner surface 7421 of the locking wheel 742, so that the bottom surface of the accommodating base 7331, the silicone layer 741 and the inner surface 7421 of the locking wheel 742 could return to the state that those components gently abut against each other, and therefore could be rotated relatively. After that, the force transmission route between the first actuator 72 and the output shaft 121 of the force-bearing mechanism 12 would be disconnected, so that the output shaft 121 could freely rotate relative to the first actuator 72. In other words, the driving mode for turning the slats could be automatically switched to manual.

Figure 48:
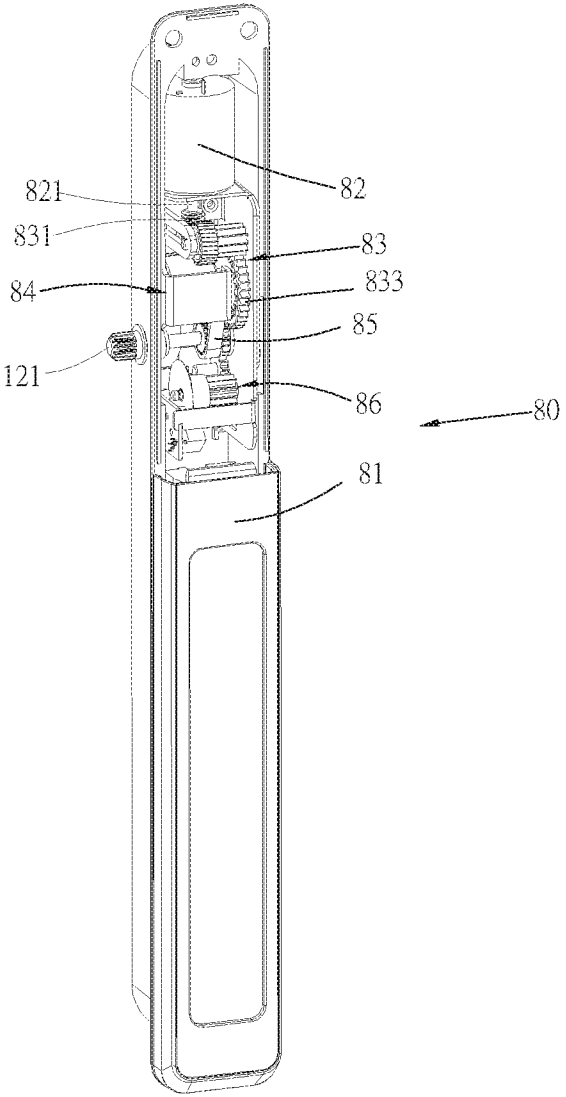
FIG. 48 is a perspective view, showing the whole control system of a seventh embodiment.
Figure 49:
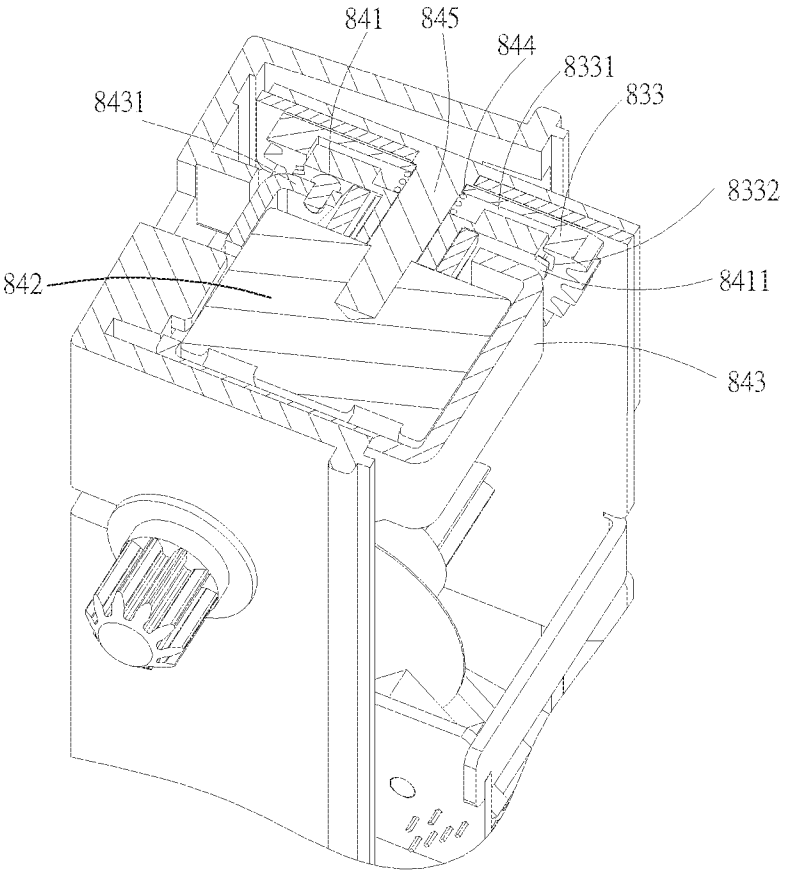
FIG. 49 is a sectional view, showing the condition when the control system of the seventh embodiment is not linked to the force-bearing mechanism.
Figure 50:
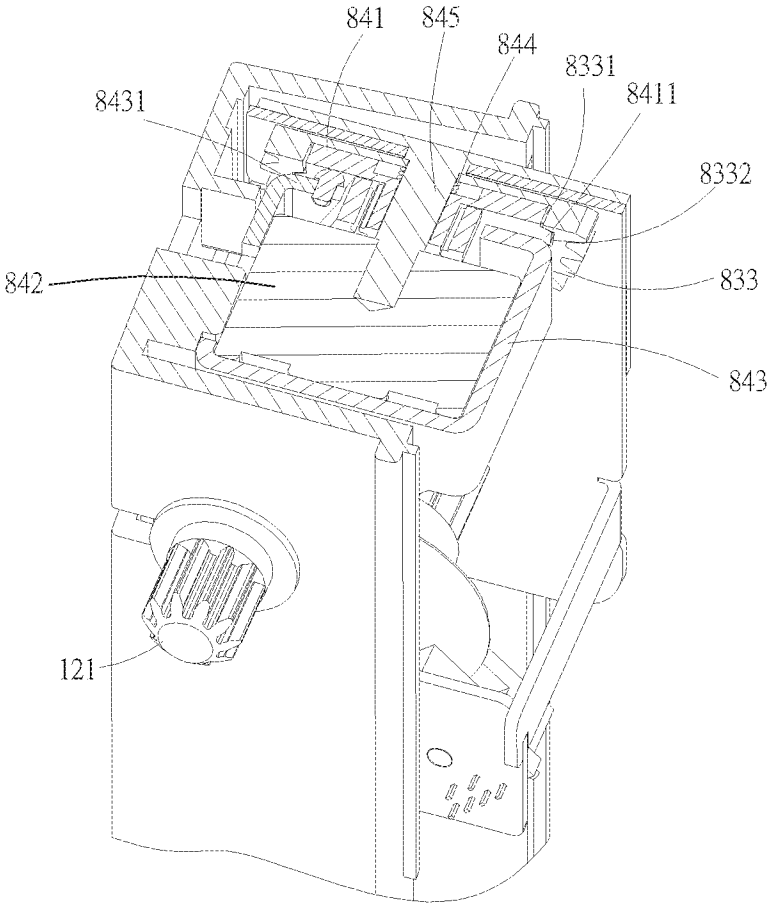
FIG. 50 is a sectional view, showing the condition when the control system of the seventh embodiment is linked to the force-bearing mechanism.
Figure 51:
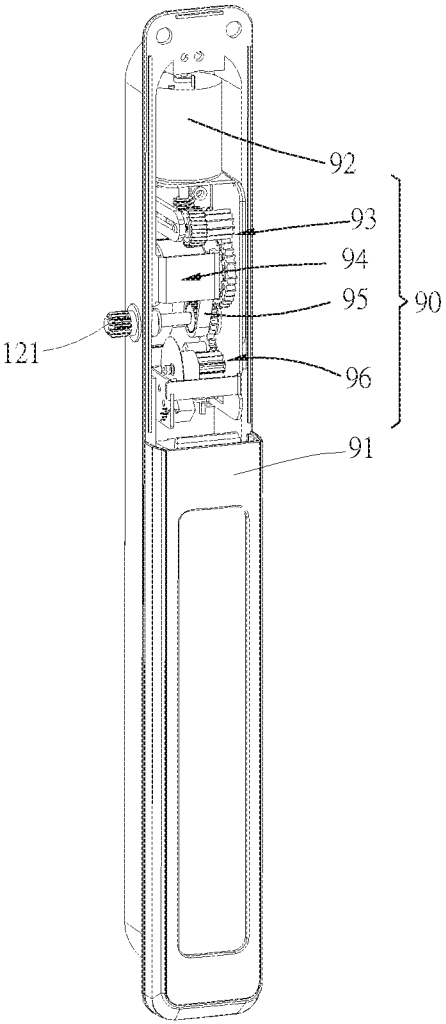
FIG. 51 is a perspective view, showing the whole control system of an eighth embodiment.
Figure 52:
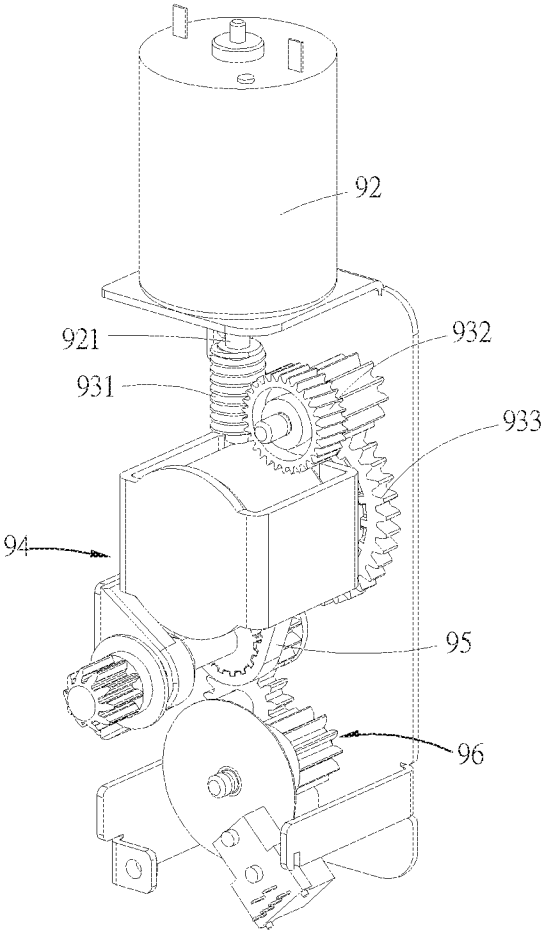
FIG. 52 is a perspective view, showing part of the control system of the eighth embodiment.
Figure 53:
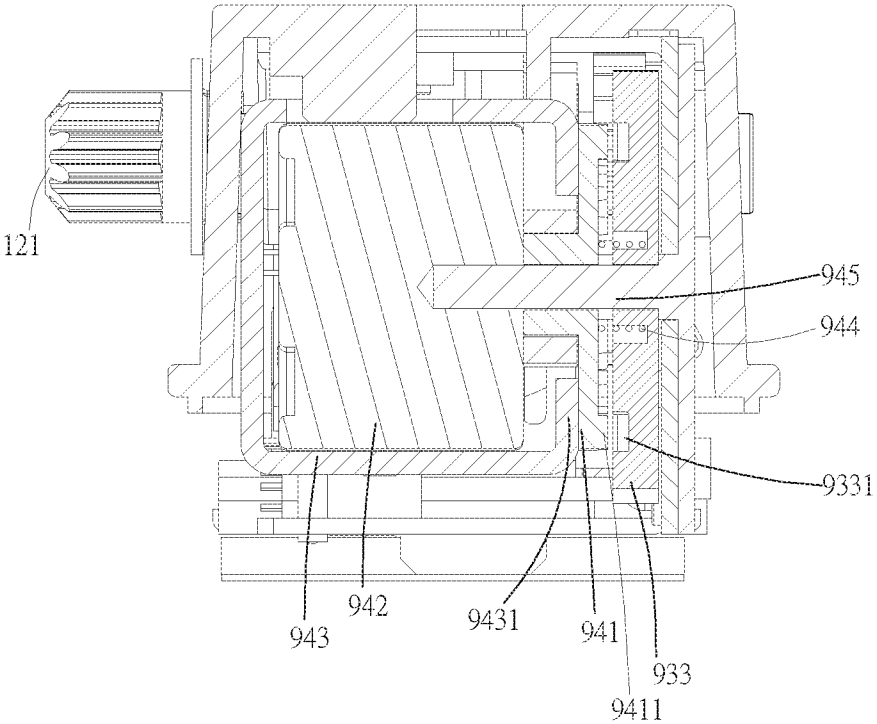
FIG. 53 is a sectional view, showing the condition when the control system of the eighth embodiment is not linked to the force-bearing mechanism.
Figure 54:
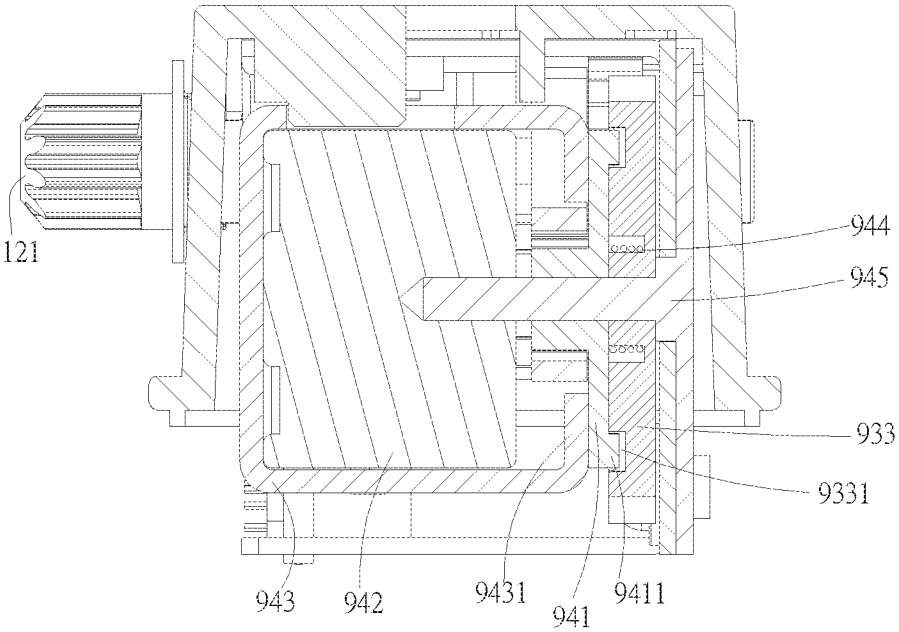
FIG. 54 is a sectional view, showing the condition when the control system of the eighth embodiment is linked to the force-bearing mechanism.
Figure 55:
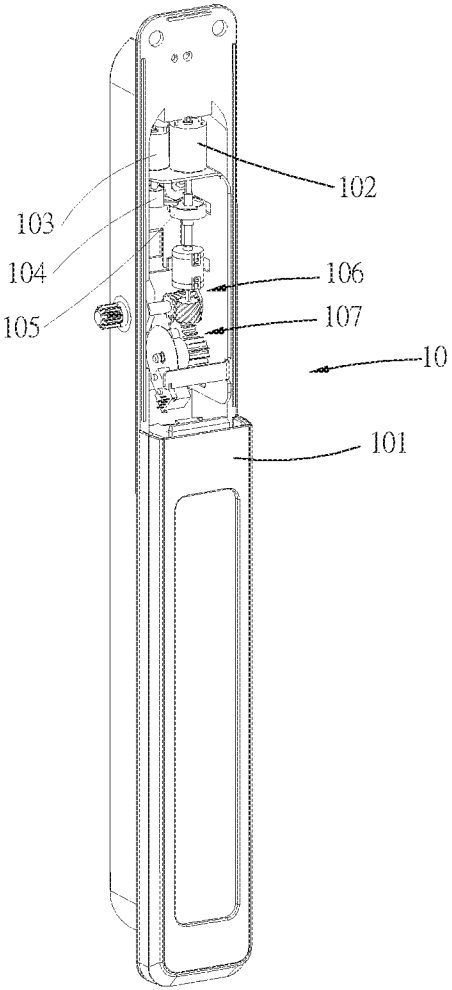
FIG. 55 is a perspective view, showing the whole control system of a ninth embodiment.
Figure 56:
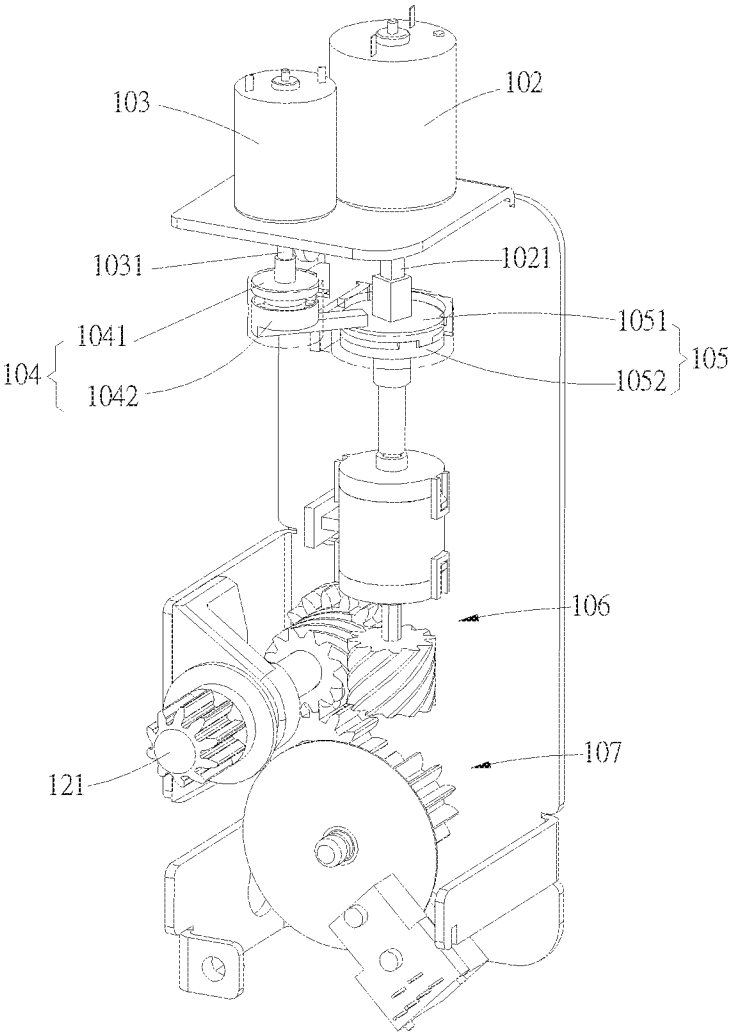
FIG. 56 is a perspective view, showing part of the control system of the ninth embodiment.
Figure 57:
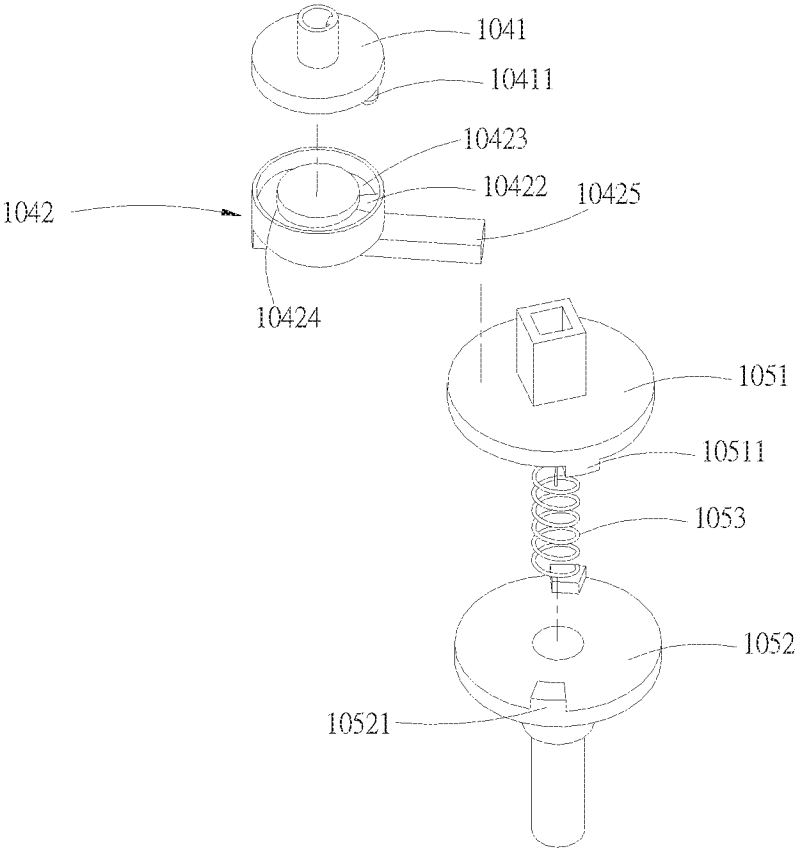
FIG. 57 is an exploded view, showing the transmission mechanism and the engaging mechanism of the control system of the ninth embodiment.
Figure 58:
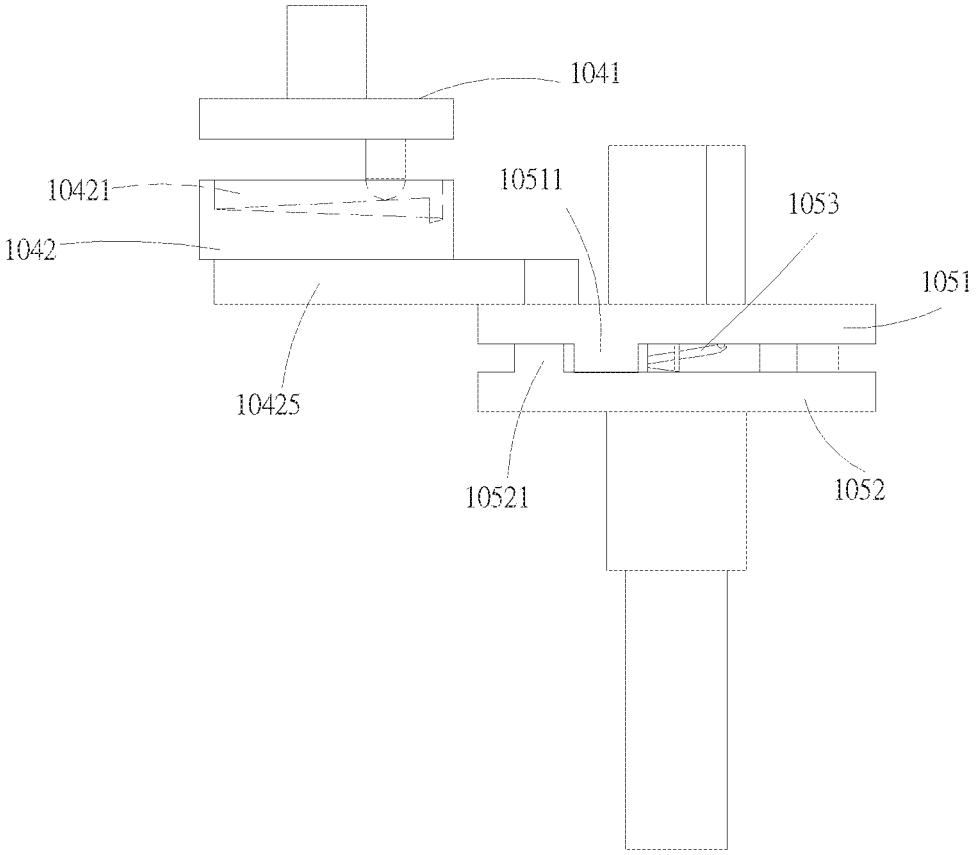
FIG. 58 is a front-side sectional view, showing the condition when the clutch mechanism of the control system of the ninth embodiment is linked to the force-bearing mechanism.

A control system 80 of a seventh embodiment of in the present disclosure is illustrated in FIG. 48 to FIG. 50, which includes an electric power member 81, a first actuator 82, a deceleration mechanism 83, an electromagnetic mechanism 84, a transmission member 85 and a position detection device 86. The electric power member 81 provides power to operate the first actuator 82 and the electromagnetic mechanism 84. The first actuator 82 has a first driving shaft 821 which is adapted to output the first driving force, and the first driving shaft 821 is connected to and driven by the deceleration mechanism 83. Whereby, the strength and the rotation speed of the first driving force could be changed after passing through the deceleration mechanism 83. The deceleration mechanism 83 includes a worm 831, a worm gear 832 and a connecting gear 833. Similar to the sixth embodiment, the first driving shaft 821 is adapted to drive the worm 831, the worm gear 832 and the connecting gear 833 to rotate, whereby the strength and the rotation speed of the first driving force could be changed through the deceleration mechanism 83. In addition, the connecting gear 833 is accommodated in an accommodating base 8331 in an axial direction thereof, and at least one first engaging portion 8332 is formed along an inner wall of the accommodating base 8331.

In the present embodiment, the electromagnetic mechanism 84 includes a locking wheel 841, a magnetic attractor 842, which is an electromagnet, an iron member 843 and a compressed spring 844. The connecting gear 833 of the deceleration mechanism 83, the locking wheel 841 and the magnetic attractor 842 are coaxially positioned on an axial shaft 845 in sequence. The locking wheel 841 could be moved along the axial shaft 845 in an axial direction to be accommodated in the accommodating base 8331 of the connecting gear 833. The locking wheel 841 further has at least one second engaging portion 8411 formed on an outer surface of the locking wheel 841, and the second engaging portion 8411 corresponds to the inner wall of the accommodating base 8331. The second engaging portion 8411 and the first engaging portion 8332 are detachably engaged with each other, so that the connecting gear 833 could freely rotate relative to the locking wheel 841, or could drive the locking wheel 841 to rotate simultaneously. In the present embodiment, the first engaging portion 8332 has a plurality of troughs, and the second engaging portion 8411 has a plurality of teeth. The compressed spring 844 is sandwiched between the locking wheel 841 and the accommodating base 8331 of the connecting gear 833, and two ends of the compressed spring 844 respectively abut against the connecting gear 833 and the locking wheel 841, whereby to outward push the connecting gear 833 and the locking wheel 841 in opposite directions. The iron member 843 of the electromagnetic mechanism 84 is a frame, which is positioned along the axis of the locking wheel 841, and the magnetic attractor 842 is accommodated within the iron member 843. The iron member 843 could be driven to move toward or away from the locking wheel 841 relative to the magnetic attractor 842. The iron member 843 has a pushing arm 8431 corresponding to the locking wheel 841, and the pushing arm 8431 is adapted to detachably abut against the locking wheel 841, whereby to drive the locking wheel 841 to move along the axial shaft 845. The transmission member 85 would mesh with the locking wheel 841 and the output shaft 121 of the force-bearing mechanism 12, so that the output shaft 121 could be rotated by transmitting a driving force from the locking wheel 841 to the output shaft 121. The structures of the transmission member 85, the locking wheel 841 and the output wheel 121, and the arrangement of the position detection device 86 are substantially the same with those in the sixth embodiment, and therefore we are not going to explain in details again herein.

When the first actuator 82 provides the first driving force through the first driving shaft 821, the magnetic attractor 842 would create a magnetic field due to the electric power provided by the electric power member 81, so that the iron member 843 would be attracted by the magnetic force of the magnetic field to resist the elastic force of the compressed spring 844, and to move toward the locking wheel 841. At the moment, the pushing arm 8431 of the iron member 843 would push the locking wheel 841 to move toward the accommodating base 8331 of the connecting gear 833. When the locking wheel 841 is moved into the accommodating base 8331, the teeth 8411 of the locking wheel 841 would be engaged with the troughs 8332 on the inner wall of the accommodating base 8331, whereby the connecting gear 833 could drive the locking wheel 841 to rotate simultaneously in the same direction, so that the strength and the rotation speed of the first driving force could be changed after passing through the deceleration mechanism 83, and the first driving force would drive the output shaft 121 of the force-bearing mechanism 12 to rotate through the transmission member 85. Furthermore, when the iron member 843 pushes the locking wheel 841 to move in an axial direction to be simultaneously operated with the connecting gear 833, the compressed spring 844 between the locking wheel 841 and the accommodating base 8331 would be compressed to store a restoring elastic force.

When the electric power member 81 stops providing the electric power to the magnetic attractor 842, the magnetic force driving the iron member 843 would disappear, whereby the restoring elastic force of the compressed spring 844 would push the locking wheel 841 to move away from the connecting gear 833 in the axial direction, and therefore the teeth 8411 of the locking wheel 841 would be disengaged from the troughs 8332 of the connecting wheel 833. When the locking wheel 841 is moved in the axial direction, the pushing arm 8431 of the iron member 843 would be driven to move away from the locking wheel 841 relative to the magnetic attractor 842, whereby the iron member 843 would return to an original position. After that, the force transmission route between the first actuator 82 and the output shaft 121 of the force-bearing mechanism 12 would be disconnected, so that the output shaft 121 could freely rotate relative to the first actuator 82. In other words, the driving mode for turning the slats could be automatically switched to manual.

A control system 90 of an eighth embodiment of the present disclosure is illustrated in FIG. 51 to FIG. 54, which includes an electric power member 91, a first actuator 92, a deceleration mechanism 93, an electromagnetic mechanism 94, a transmission member 95 and a position detection device 96. The electric power member 91 is adapted to provide power to operate the first actuator 92 and the electromagnetic mechanism 94. The first actuator 92 has a first driving shaft 921 which is adapted to output the first driving force, and the first driving shaft 921 is connected to and driven by the deceleration mechanism 93. Whereby, the strength and the rotation speed of the first driving force could be changed after passing through the deceleration mechanism 93. The deceleration mechanism 93 includes a worm 931, a worm gear 932 and a connecting gear 933. The structures and arrangements of these components are similar to those in the sixth embodiment. The first driving shaft 921 drives the worm 931, the worm gear 932 and the connecting gear 933 to rotate, whereby to change the strength and the rotation speed of the first driving force through the deceleration mechanism 93. In addition, at least one first engaging portion 9331 is formed in an axial direction of the connecting gear 933. The electromagnetic mechanism 9 includes a locking wheel 941, a magnetic attractor 942, which is an electromagnet, an iron member 943 and a compressed spring 944. The connecting gear 933 of the deceleration mechanism 93, the locking wheel 941 and the magnetic attractor 942 are coaxially positioned on an axial shaft 945 in sequence. The locking wheel 941 could be moved along the axial shaft 945 in an axial direction thereof, and at least one second engaging portion 9411 is formed in an axial direction of the locking wheel 941. The second engaging portion 9411 and the first engaging portion 9331 are detachably engaged with each other, so that the connecting gear 933 could freely rotate relative to the locking wheel 941, or could drive the locking wheel 941 to rotate simultaneously. In the present embodiment, the first engaging portion 9331 has a plurality of recesses, and the second engaging portion 9411 has a plurality of bumps, each of which respectively corresponds to one of the recesses. In addition, the compressed spring 944 is sandwiched between the locking wheel 941 and the connecting gear 933, and two ends of the compressed spring 944 could outward push the connecting gear 933 and the locking wheel 941 in opposite directions.

The iron member 943 of the electromagnetic mechanism 94 is a frame, which is positioned along the axis of the locking wheel 941, and the magnetic attractor 942 is accommodated within the iron member 943. The iron member 943 could be driven to move toward or away from the locking wheel 941 relative to the magnetic attractor 942. The iron member 943 has a pushing arm 9431 corresponding to the locking wheel 941, and the pushing arm 9431 is adapted to detachably abut against the locking wheel 941, whereby to drive the locking wheel 941 to move along the axial shaft 945. The transmission member 95 would mesh with the locking wheel 941 and the output shaft 121 of the force-bearing mechanism 12, whereby to transmit a driving force from the locking wheel 941 to the output shaft 121. The structures of the transmission member 95, the locking wheel 941 and the output wheel 121, and the arrangement of the position detection device 96 are substantially the same as the sixth embodiment. Therefore we are not going to illustrate in details again herein.

When the first actuator 92 provides the first driving force through the first driving shaft 921, the strength and the rotation speed of the first driving force would be changed through the deceleration mechanism 93. At the same time, the magnetic attractor 942 would create a magnetic field due to the electric power from the electric power member 91, so that the iron member 943 would be attracted by the magnetic force of the magnetic field to move toward the locking wheel 941. At the moment, the pushing arm 9431 of the iron member 943 would push the locking wheel 941 to move toward the connecting gear 933, whereby the second engaging portion (i.e., the bumps) 9411 of the locking wheel 941 could be engaged with the first engaging portion (i.e., the recesses) 9331 of the connecting gear 933. After that, the connecting gear 933 could drive the locking wheel 941 to rotate simultaneously in the same direction, and could drive the output shaft 121 of the force-bearing mechanism 12 to rotate through the transmission member 95. When the locking wheel 941 is moved in the axial direction to be simultaneously driven with the connecting gear 933, the compressed spring 944 between the locking wheel 941 and the connecting gear 933 would be compressed to store a restoring elastic force.

When the electric power member 91 stops providing the electric power to the magnetic attractor 942, the magnetic force driving the iron member 943 would disappear, whereby the restoring elastic force of the compressed spring 944 would push the locking wheel 941 to move away from the connecting gear 933 in an axial direction, and therefore the bumps 9411 of the locking wheel 941 would be disengaged from the first engaging portion (i.e., the recesses) 9331 of the connecting wheel 933. When the locking wheel 941 is moved in the axial direction, the pushing arm 9431 of the iron member 943 would be driven to move away from the locking wheel 941 relative to the magnetic attractor 942, and therefore the iron member would return to an original position. After that, the force transmission route between the first actuator 92 and the output shaft 121 of the force-bearing mechanism 12 would be disconnected through the operation of the electromagnetic mechanism 94, so that the output shaft 121 could freely rotate relative to the first actuator 92. In this way, the driving mode for turning the slats could be automatically switched to manual.

A control system 10 of a ninth embodiment of the present disclosure is illustrated in FIG. 55 to FIG. 58, which includes an electric power member 101, a first actuator 102, a second actuator 103, a transmission mechanism 104, an engaging mechanism 105, a deceleration mechanism 106 and a position detection device 107. The electric power member 101 is adapted to provide power to operate the first actuator 102 and the second actuator 103. The first actuator 102 has a first driving shaft 1021 which is connected to the engaging mechanism 105, and the engaging mechanism 105 is further connected to the deceleration mechanism 106. In addition, the second actuator 103 has a second driving shaft 1031 which is connected to the transmission mechanism 104.

The transmission mechanism 104 includes a first transmission unit 1041 and a second transmission unit 1042, wherein the first transmission unit 1041 and the second transmission unit 1042 are correspondingly positioned, and the first transmission unit 1041 is connected to the second driving shaft 1031. The second driving shaft 1031, the first transmission unit 1041 and the second transmission unit 1042 are axially positioned in sequence, and the first transmission unit 1041 could be directly driven to rotate by the second output shaft 1031. The first transmission unit 1041 has a protrusion 10411 protruded from one side thereof facing the second transmission unit 1042, and the second transmission unit 1042 has an annular guiding rail 10421 recessed into one side thereof facing the first transmission unit 1041, wherein the annular guiding rail 10421 corresponds to the protrusion 10411. The annular guiding rail 10421 has a thick end 10422, a thin end 10423 and a curved inclined surface 10424 connected between the thick end 10422 and the thin end 10423. When the first transmission unit 1041 rotates, the protrusion 10411 could go back and forth along the inclined surface 10424 from the thick end 10422 to the thin end 10423 of the guiding rail 10421, whereby to drive the second transmission unit 1042 to move back and forth in an axial direction.

The engaging mechanism 105 includes a first clutch unit 1051, a second clutch unit 1052 and a restoring spring 1053, wherein the first clutch unit 1051 and the second clutch unit 1052 are positioned correspondingly, and the restoring spring 1053 is positioned between the first clutch unit 1051 and the second clutch unit 1052. The first clutch unit 1051 is also connected to the first output shaft 1021 of the first actuator 102, wherein the first driving shaft 1021, the first clutch unit 1051, the restoring spring 1053 and the second clutch unit 1052 are axially positioned in sequence, so that the first clutch unit 1051 could be driven to rotate by the first driving shaft 1021. The first clutch unit 1051 has a first linking portion 10511 extending from one side thereof facing the second clutch unit 1052, and the second clutch unit 1052 has a second linking portion 10521 extending from one side thereof facing the first clutch unit 1051, wherein the first linking portion 10511 and the second linking portion 10521 correspond to each other. Furthermore, the first linking portion 10511 and the second linking portion 10521 could be selectively detached from each other, or could abut against each other in lateral directions. In the current embodiment, the first linking portion 10511 is a first bump, and the second linking portion 10521 is a second bump. The second transmission unit 1042 of the transmission mechanism 104 further has a pressing bar 10425 extending in a radial direction thereof, and the pressing bar 10425 is adapted to press on the first clutch unit 1051. Accordingly, when the second transmission unit 1042 is pushed by the first transmission unit 1041 to move away from the first transmission unit 1041, the pressing bar 10425 would press the first clutch unit 1051 to move toward the second clutch unit 1052. At the moment, the first bump 10511 would abut against the second bump 10521, so that the first clutch unit 1051 could drive the second clutch unit 1052 to rotate as the first bump 10511 pushing the second bump 10521. When the pressing bar 10425 of the second transmission unit 1042 does not press on the first clutch unit 1051, the first clutch unit 1051 would be pushed by the restoring spring 1053 to be detached from the second clutch unit 1052, and therefore the first bump 10511 and the second bump 10521 would no longer contact each other.

In the present embodiment, the arrangements of the deceleration mechanism 106 and the position detection device 107 are the same as those in the previous embodiments. The second clutch unit 1052 would be driven by the deceleration mechanism 106. The first actuator 102 outputs the first driving force through the first output shaft 1021, and then the first driving force would be transmitted to the second clutch unit 1052 through the first clutch unit 1051. The strength and the rotation speed of the first driving force could be changed through the deceleration mechanism 106; after that, the output shaft 121 of the force-bearing mechanism 12 would be rotated to turn the slats. Furthermore, the output shaft 121 would be synchronously driven by the position detection device 107 in correspondence with the differentiation of the current tilt angle of the slats.

In the present embodiment, when the control system is operated, the second driving shaft 1031 of the second actuator 103 outputs a first transmission force to drive the first transmission member 1041 of the transmission mechanism 104 to rotate, so that protrusion 10411 of the first transmission unit 1041 could move from the thin end 10423 to the thick end 10422 of the guiding rail 10421 of the second transmission unit 1042, whereby to push the second transmission unit 1042 away from the first transmission unit 1041. After that, the pressing bar 10425 would push the first clutch unit 1051 of the engaging mechanism 105 to move toward the second clutch unit 1052. At the same time, the compressed spring 1053 between the first clutch unit 1051 and the second clutch unit 1052 would be compressed to store a restoring elastic force. When the protrusion 104111 of the first transmission unit 1041 is moved to the thick end 10422 of the guiding rail 10421 of the second transmission unit 1042, the first bump 10511 of the first clutch unit 1051 would abut against the second bump 10521 of the second clutch unit 1052 in the lateral direction. At the moment, the second actuator 103 would stop operating, so that the pressing bar 1031 would stay at a position when the protrusion 104111 of the first transmission unit 1041 stays at the thick end 10422 of the guiding rail 10421, whereby the first bump 10511 of the first clutch unit 1051 and the second bump 10521 of the second clutch unit 1052 would keep abutting against each other. In addition, the first driving force provided through the first driving shaft 1021 of the first actuator 102 could be transmitted through the engagement of the first clutch unit 1051 and the second clutch unit 1052, and the first driving force could rotate the output shaft 121 of the force-bearing mechanism 12 through the deceleration mechanism 106. At the same time, the position detection device 107 could be driven in correspondence with the differentiation of the current tilt angle of the slats.

When the second driving shaft 1031 of the second actuator 103 outputs a second transmission force, which rotates in a rotation direction opposite to that of the first transmission force, the second transmission force drives the protrusion 104111 of the first transmission unit 1041 to move from the thick end 10422 to the thin end 10423 of the guiding rail 10421 of the second transmission unit 1042. At the same time, the second transmission unit 1042 would move toward the first transmission unit 1041, and would drive the pressing bar 10425 to move away from the first clutch unit 1501, whereby to stop pushing the first clutch unit 1051 toward the second clutch unit 1052. Furthermore, the first clutch unit 1051 would be pushed by the restoring spring 1053 to move away from the second clutch unit 1052; when the protrusion 10411 is moved to the thin end 10423, the second actuator 103 would stop outputting the second transmission force.

In the current embodiment, the first actuator 102 could be operated earlier than the second actuator 103, whereby the first clutch unit 1051 could be rotated by the first driving force while the first clutch unit 1051 is moved toward the second clutch unit 1052. In this way, the first bump 10511 of the first clutch unit 1051 could easily abut against the second bump 10521 of the second clutch unit 1052 in the lateral direction, which would prevent the problem that the top surface of the first bump 10511 of the first clutch unit 1051 happens to directly face the top surface of the second bump 10521 of the second clutch unit 1052 when the second transmission unit 1042 drives the first clutch unit 1051 to move toward the second clutch unit 1052 in the axial direction. Such situation would hinder the lateral abutting relation between the first bump 10511 and the second bump 10521. With the aforementioned mechanism, even if the top surface of the first bump 10511 happens to directly face the top surface of the second bump 10521, the first clutch unit 1051 would rotate by itself to immediately shift the first bump 10511, so that the first bump 10511 could be aligned with the second bump 10521 in the lateral direction. Therefore, the first bump 10511 and the second bump 10521 could successfully engage with each other while the first clutch unit 1051 is moved toward the second clutch unit 1052.

It is worth mentioning that, the deceleration mechanism, the position detection device and the force-bearing mechanism disclosed in one of the aforementioned embodiments could work with the clutch mechanism disclosed in another one of the aforementioned embodiments. In other words, the arrangements described in the previous embodiments are not limitations of the present invention, as long as the transmission route of the first driving force could be established or disconnected through the clutch mechanism. The clutch mechanism includes an input member and an output member, wherein the input member and the output member are able to be driven to be connected to each other to be operated synchronously, and the input member and the output member are also able to be driven to be disconnected from each other to be operated independently. On the premise that the driving modes are not necessary to be switched manually, the driving mode to adjust the angle of slats could be automatically switched to manual once the control system stops operating, whereby the force-bearing mechanism, the slats of the shutter and the control system could be prevented from being damaged due to improper and incorrect mode switching.

It must be pointed out that the embodiments described above are only some preferred embodiments of the present invention. All equivalent structures which employ the concepts disclosed in this specification and the appended claims should fall within the scope of the present invention.

What is claimed is:

1. A control system for a shutter, wherein the shutter includes a force-bearing mechanism and a plurality of slats; the control system comprising:

a power source;

a driving device, which is connected to the power source, wherein the driving device driven by the power source to output a first driving force, wherein the first driving force is used to drive the force-bearing mechanism to rotate the slats; and a clutch mechanism, which is adapted to be driven to optionally allow the driving device to drive the force-bearing mechanism, wherein the clutch mechanism comprises an input member and an output member; the input member and the output member are able to be driven to be connected to each other to be operated synchronously, and the input member and the output member are also able to be driven to be disconnected from each other to be operated independently;

when the driving device outputs the first driving force, and the input member of the clutch mechanism is engaged with the output member, the first driving force is transmitted to the force-bearing mechanism through the clutch mechanism, whereby to drive the slats to rotate;

when the driving device stops outputting the first driving force, the input member of the clutch mechanism is disengaged from the output member, and the slats and the force-bearing mechanism are able to rotate independently relative to the driving device.

2. The control system of claim 1, wherein the input member of the clutch mechanism is driven by the first driving force of the driving device to be engaged with the output member.

3. The control system of claim 2, wherein the clutch mechanism further comprises a movable arm; the input member comprises a central member, and the output member comprises a friction base; the central member is located in the friction base, and the movable arm is between the central member and the friction base; the movable arm is operated with the central member, the central member is operated with the driving device, and the friction base is operated with the force-bearing mechanism; when the central member is driven by the first driving force, the movable arm is moved by a movement of the central member toward an inner surface of the friction base; when the movable arm is moved to tightly abut against an inner surface of the friction base, the input member and the output member are driven correspondingly with each other, whereby the force-bearing mechanism is drivable by the first driving force.

4. The control system of claim 3, wherein the clutch mechanism further comprises a tension spring, of which two ends are respectively connected to the movable arm and the central member; the tension spring constantly applies a pulling force to the movable arm, so that the movable arm is able to be pulled away from the inner surface of the friction base.

5. The control system of claim 2, wherein the driving device is further driven by the power source to output a second driving force; a rotation direction of the second driving force is opposite to a rotation direction of the first driving force; when the driving device outputs the second driving force, the first driving force stops, and the input member of the clutch mechanism is driven by the second driving force to disconnect from the output member.

6. The control system of claim 5, wherein the clutch mechanism further comprises a swing arm and at least one transmission gear, the awing arm has a pivoting axle, so that the swing arm is able to pivot about the pivoting axle; the input member comprises a central gear, and the output member comprises an engaging gear; the central gear and the pivoting axle are coaxially positioned; the at least one transmission gear is provided at the swing arm, and the transmission gear meshes with the central gear; the central gear and the driving device are operated with each other; the engaging gear and the force-bearing mechanism are operated with each other;

when the first driving force drives the central gear to rotate, the central gear drives the at least one transmission gear to rotate, and a rotation of the central gear also drives the swing arm to pivot in a first pivoting direction till the at least one transmission gear meshes with the engaging gear, whereby to transmit the first driving force to the force-bearing mechanism;

when the at least one transmission gear meshes with the engaging gear, and the second driving force drives the central gear and the at least one transmission gear to rotate, the swing arm is able to pivot in a second pivoting direction opposite to the first pivoting direction till the at least one transmission gear is disengaged from the engaging gear, so that the force-bearing mechanism is able to be operated independently relative to the driving device.

7. The control system of claim 6, wherein the swing arm includes a first end and a second end opposite to the first end; the pivoting axle is positioned at the first end; the second end further includes a positioning member, and an axis of the engaging gear passes through the positioning member; when the swing arm is pivoted by the central gear, the positioning member of the engaging gear confines the axis of the engaging gear, whereby to limit a pivoting range of the swing arm.

8. The control system of claim 5, wherein the clutch mechanism further comprises an inner base and a ball; the input member comprises a rotating body, and the output member comprises an outer base; the rotating body, the inner base and the outer base are coaxially positioned from inside to outside in sequence, the rotating body and the driving device are operated with each other, and the outer base and the force-bearing mechanism are operated with each other; the inner base has an opening which is larger than the ball; the ball is correspondingly positioned in the opening, and is able to move along the opening inward and outward relative to the inner base, whereby to optionally connect the rotating body and the inner base, or to optionally connect the inner base and the outer base; when the ball connects the rotating body and the inner base, the input member and the output member are no longer linked with each other, so that the force-bearing mechanism is able to rotate independently relative to the driving device; when the ball connects the inner base and the outer base, the input member and the outer member are able to rotate synchronously in the same direction, so that the first driving force is able to drive the force-bearing mechanism to rotate.

9. The control system of claim 8, wherein the outer base has an annular inner surface facing the inner base, and the inner surface has a rib protruded therefrom toward the inner base, the rotating body has at least one groove corresponding to the opening of the inner base; when the rotating body is driven by the first driving force till the groove does not face the opening, the ball protrudes from the opening to abut against the rib, so that the inner base drives the outer base to operate simultaneously; when the rotating body is driven by the second driving force till the groove faces the opening, the ball is at a space formed between the groove and the opening, and the ball is not protruded from the opening, and no longer contacts the outer base, so that the inner base is able to rotate synchronously with the rotating body.

10. The control system of claim 8, wherein the rotating body has an outer surface, and the outer surface has a bump protruded therefrom; the inner base has an inner surface facing the outer surface of the rotating body, and the inner surface has a blocker protruded therefrom; the blocker corresponds to the bump; when the rotating body is rotated by the first driving force till the bump abuts against the blocker in a lateral direction, the rotating body is rotated continuously to rotate the inner base; when the rotating body is rotated by the second driving force, the bump and the blocker are detached from each other, so that the rotating body and the inner base are no longer linked with each other.

11. The control system of claim 5, wherein the clutch mechanism further comprises a movable wheel; the input member comprises a first clutch wheel, and the output member comprises a second clutch wheel; the movable wheel is positioned between the first clutch wheel and the second clutch wheel, and the first clutch wheel, the movable wheel and the second clutch wheel are coaxially positioned with intervals formed therebetween; the first clutch wheel and the driving device are operated with each other, and the second clutch wheel and the force-bearing mechanism are operated with each other; when the first clutch wheel is driven by the first driving force of the driving device to connect the movable wheel and to drive the movable wheel to operate, the movable wheel is driven by the first clutch wheel to connect the second clutch wheel and to drive the second clutch wheel to operate, so that the first driving force of the driving device is able to drive the force-bearing mechanism to operate through the clutch mechanism.

12. The control system of claim 11, wherein the first clutch wheel has a first end surface; the movable wheel has a second end surface facing the first end surface, and a third end surface opposite to the second end surface; the second clutch wheel has a fourth end surface facing the third end surface, and the clutch mechanism further comprises a restoring spring positioned between the movable wheel and the second clutch wheel; the first end surface has at least one first peak and at least one first valley, the second end surface has at least one second peak and at least one valley, and the at least first peak corresponds to the at least one second valley; the movable wheel has an inclined surface between the second peak and the adjacent second valley, the third end surface is a toothed engaging surface, and the fourth end surface is a toothed meshing surface, the toothed meshing surface corresponds to the toothed engaging surface;

when the first driving force drives the first clutch wheel to rotate, whereby the first peak pushes the inclined surface of the movable wheel; the movable wheel is forced to move toward the second clutch wheel, and the toothed engaging surface of the movable gear meshes with the second toothed meshing surface, so that the first clutch wheel is able to drive the second clutch wheel through the movable wheel, and therefore the first driving force is able to transmit to the force-bearing mechanism to drive the slats through the clutch mechanism; when the second driving force drives the first clutch wheel to reversely rotate till the first toothed peak is detached from the inclined surface, the restoring spring pushes the movable wheel to move in an axial direction till the toothed engaging surface is disengaged from the toothed meshing surface of the second clutch wheel, so that the force-bearing mechanism is able to be operated independently relative to the driving device.

13. The control system of claim 1, wherein the clutch mechanism further comprises an electromagnetic assembly coupled to the power source; the electromagnetic assembly is driven by the power source to engage the input member with the output member.

14. The control system of claim 13, wherein the electromagnetic assembly of the clutch mechanism comprises a yoke, which is hollow and circular; the yoke is wound around by coils; the coils and the power source are electrically connected to each other, the input member comprises a rotor base, and the output member comprises a rotor; the rotor base and the rotor are rotatably positioned in the yoke, and correspond to each other; the electromagnetic assembly further comprises magnetic powders distributed between the rotor base and the rotor; the rotor base and the driving device are operated with each other, and the rotor and the force-bearing mechanism are operated with each other; when the coils and the yoke are driven to create a magnetic field by the power source, the magnetic powders distributed between the rotor base and the rotor are aligned by the magnetic field to form a linkage between the rotor base and the rotor, so that the input member and the output member are operated synchronously in the same direction, whereby the first driving force is able to drive the force-bearing mechanism to operate through the clutch mechanism; when the power source stops outputting an electric power to the coils, the magnetic field disappears, so that the linkage formed by the magnetic powders between the rotor base and the rotor also disappears, and therefore the input member and the output member are no longer linked to each other, and the force-bearing mechanism is able to be operated independently relative to the driving device.

15. The control system of claim 13, wherein the electromagnetic assembly comprises a magnetic attractor and an iron member; the magnetic attractor is positioned in the iron member, and is electrically connected to the power source; the input member comprises a driving wheel, and the output member comprises a driven wheel; the driving wheel, the driven wheel and the magnetic attractor are coaxially positioned; the driving wheel and the driving device are operated with each other, and the driven wheel and the force-bearing mechanism are operated with each other; when the magnetic attractor creates a magnetic field by the power source, the magnetic field drives the iron member to move relative to the magnetic attractor in an axial direction, whereby the iron member pushes the driven wheel to move in the axial direction till the driven wheel and the driving wheel are connected to and operated with each other, wherein the input member and the output member are operated synchronously in the same direction, so that the first driving force drives the force-bearing mechanism to rotate through the clutch mechanism; when the power source stops outputting an electric power to the magnetic attractor, the magnetic field disappears, and a pushing force from the iron member applied to the driven wheel also disappears, whereby the driven wheel is able to be rotated independently relative to the driving wheel, and the force-bearing mechanism is able to be operated independently relative to the driving device.

16. The control system of claim 15, wherein the clutch mechanism further comprises an elastic member positioned between the driving wheel and the driven wheel; when the power source stops outputting the electric power to the magnetic attractor, the pushing force from the iron member applied to the driven wheel disappears, so that the elastic member drives the driven wheel to move in the axial direction till the driven member is not driven along with the driving member.

17. The control system of claim 1, wherein the control system further comprises a transmission mechanism operated with the clutch mechanism, and the driving device is further driven by the power source to generate and output a first transmission force and a second transmission force; a rotation direction of the second transmission force is opposite to a rotation direction of the first transmission force; when the transmission mechanism is driven by the first transmission force to drive the input member of the clutch mechanism to engage with the output member, the first driving force drives the force-bearing mechanism to operate through the clutch mechanism, and the driving device stops outputting the first transmission force while the input member and the output member are engaged with each other; when the driving device outputs the second transmission force, and the first transmission force is stopped being outputted, a driving force from the transmission mechanism to drive the input member to connect the output member disappears, so that the force-bearing mechanism is able to be operated independently relative to the driving device.

18. The control system of claim 17, wherein the transmission member comprises a first transmission member and a second transmission member; the first transmission member corresponds to the second transmission member, and the clutch mechanism further comprises an elastic member provided between the input member and the output member; the first transmission member and the driving device are operated with each other, and the second transmission member and the input member are operated with each other; the elastic member constantly applies a pushing force to separate the output member from the input member; when the first transmission member is driven by the first transmission force to force the second transmission to move, the second transmission member is driven the input member to engage with the output member; when the driving device outputs the second transmission force, and stops outputting the first transmission force, the pushing force drives the input member to detach from the output member.

19. The control system of claim 18, wherein the first transmission member has a protrusion formed on one side thereof facing the second transmission member, and the second transmission member has an annular guiding rail formed on one side thereof facing the protrusion; the annular guiding rail has a thick end, an inclined slope and a thin end, the inclined slope connects the thick end and the thin end, and the protrusion is able to move back and forth along the thick end, the inclined slope and the thin end of the annular guiding rail; when the first transmission member is driven by the first transmission force, the protrusion is moved along the inclined slope from the thin end to the thick end, whereby to force the second transmission member to move in an axial direction, so that the input member is moved toward the output member till the input member is engaged with the output member.

20. The control system of claim 1, further comprising a deceleration mechanism provided between the driving device and the input member of the clutch mechanism, or provided between the output member of the clutch mechanism and the force-bearing mechanism; a strength and a rotation speed of the first driving force outputted from the driving device is able to be changed by the deceleration mechanism.

21. The control system of claim 20, wherein the deceleration mechanism is selected from the group consisting of at least one deceleration gear, at least one planetary gear decelerator, a couple of a worm and a worm gear, and combinations thereof; the deceleration mechanism is adapted to reduce the rotation speed of the first driving force and increase a strength of the first driving force generated from the driving device.

22. The control system of claim 1, further comprising a position detection device operated with the force-bearing mechanism; the position detection device is operated while the force-bearing mechanism is operated.

23. The control system of claim 22, wherein the position detection device comprises an encoder disk, an encoder gear, a light source and an optical sensor, the encoder gear and the force-bearing mechanism are operated with each other, and the encoder gear and the encoder disk are coaxially fixed; the encoder disk has a plurality of permeable code holes; the light source and the optical sensor are respectively positioned on two opposite sides of the encoder disk; the force-bearing mechanism is driven to rotate the encoder gear and the encoder disk; a light from the light source passes through one of the code holes, and is received by the optical sensor.

24. The control system of claim 22, wherein the position detection device comprises a fixed board, a plurality of metal stators, a plurality of metal movers and an adjusting rod; the adjusting rod and the force-bearing mechanism are operated with each other, and the adjusting rod is respectively fixedly connected to the metal movers; the metal stators are fixed on the fixed board in an upright position, and are parallel to each other; the position detection device further comprises a gap between each two adjacent metal stators; the metal movers are pivoted by the adjusting rod about the adjusting rod to enter or leave from the gaps; when the force-bearing mechanism is operated to rotate the adjusting rod, an overlapping area between the metal stators and the metal movers is changed.

25. The control system of claim 1, wherein the force-bearing mechanism comprises an output shaft, a first toothed rack, a second toothed rack and a plurality of pivoting axles; the first toothed rack and the second toothed rack are positioned parallel to each other; the output shaft and the pivoting axles positioned between the first toothed rack and the second toothed rack, meshing with the first toothed rack and second toothed rack; the pivoting axles and the slats are fixedly connected; the output shaft is driven by the first driving force outputted by the driving device to drive the first toothed rack and the second toothed rack to move relative to each other, whereby to rotate the pivoting axles and the slats; or, one of the pivoting axles is rotated by a rotation of the corresponding slat to drive the first toothed rack and the second toothed rack to move relative to each other, whereby to rotate the output shaft without being driven by the driving device.

26. The control system of claim 1, wherein the force-bearing mechanism comprises an output shaft and a rod; the output shaft is fixedly connected to one of the slats; the rod has a plurality of connecting portions, and each of the connecting portions is pivotally connected to the corresponding slat; the output shaft is driven by the first driving force outputted by the driving device to drive the slats to rotate in the same direction through the rod; or, when the rod is driven by an external force to rotate the slats in the same direction, the output shaft is rotated with the slats synchronously without being driven by the driving device.

* * * * *